US007093526B2

(12) United States Patent
Ando et al.

(10) Patent No.: US 7,093,526 B2
(45) Date of Patent: Aug. 22, 2006

(54) FORMING DIE APPARATUS

(75) Inventors: Shoichi Ando, Sayama (JP); Hiroshi Ono, Sayama (JP); Tadashi Kobayashi, Sayama (JP); Mitsuru Kamikawa, Sayama (JP); Fumio Fukuda, Kikuchi-gun (JP); Eiki Matsuura, Kikuchi-gun (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/789,347

(22) Filed: Feb. 26, 2004

(65) Prior Publication Data

US 2004/0255635 A1 Dec. 23, 2004

Related U.S. Application Data

(62) Division of application No. 09/575,348, filed on May 19, 2000, now abandoned.

(30) Foreign Application Priority Data

| | | |
|---|---|---|
| May 20, 1999 | (JP) | 11-139568 |
| May 20, 1999 | (JP) | 11-139569 |
| May 20, 1999 | (JP) | 11-139570 |
| Jun. 21, 1999 | (JP) | 11-173803 |
| Jun. 21, 1999 | (JP) | 11-173804 |
| Jun. 21, 1999 | (JP) | 11-173805 |
| Jul. 21, 1999 | (JP) | 11-206351 |
| Jul. 21, 1999 | (JP) | 11-206352 |

(51) Int. Cl.
*B26D 7/00* (2006.01)

(52) U.S. Cl. ..... 83/648; 83/124; 83/620; 83/914

(58) Field of Classification Search ..... 83/124, 83/125, 126, 128, 914, 182, 188, 193, 648, 83/685, 618, 620–622; 72/340, 334
See application file for complete search history.

(56) References Cited

U.S. PATENT DOCUMENTS

| | | | | |
|---|---|---|---|---|
| 2,604,164 | A * | 7/1952 | Gavurin | 83/107 |
| 2,772,735 | A * | 12/1956 | Wakelee | 72/294 |
| 3,119,292 | A * | 1/1964 | Schmid | 83/124 |
| 3,211,034 | A * | 10/1965 | Andris | 83/137 |
| 3,440,909 | A * | 4/1969 | Bernet et al. | 83/61 |
| 3,570,343 | A * | 3/1971 | Wolnosky et al. | 83/124 |
| 4,267,753 | A * | 5/1981 | Bennett | 83/124 |
| 4,463,637 | A * | 8/1984 | Delio et al. | 83/40 |
| 4,785,695 | A * | 11/1988 | Riley | 83/49 |
| 5,247,862 | A * | 9/1993 | Haack | 83/27 |
| 5,845,553 | A * | 12/1998 | Kooken et al. | 83/23 |

(Continued)

FOREIGN PATENT DOCUMENTS

| | | |
|---|---|---|
| JP | 58-215237 | 12/1983 |

(Continued)

*Primary Examiner*—Charles Goodman
(74) *Attorney, Agent, or Firm*—Hamre, Schumann, Mueller & Larson, P.C.

(57) ABSTRACT

A method of manufacturing a billet for cold forging according to the present invention is characterized by the first spheroidizing annealing step of spheroidizing a carbide in a blank, the drawing step of drawing the blank at a predetermined sectional area reduction ratio after the first spheroidizing annealing step, and the second spheroidizing annealing step of promoting the dispersion of the internal carbide for an increased spheroidizing ratio after the drawing step. The drawing step has a drawing ratio of approximately 20%. The blank is cut to a desired dimension between said first spheroidizing annealing step and said second spheroidizing annealing step.

15 Claims, 39 Drawing Sheets

U.S. PATENT DOCUMENTS 6,009,783 A * 1/2000 Taijonlahti et al. ..... 83/124
6,035,688 A * 3/2000 Nagao et al. ..... 72/342.3

FOREIGN PATENT DOCUMENTS

JP 60-102245 6/1985
JP 7-034190 2/1995
JP 7-097656 4/1995
JP 7-300653 11/1995
JP 9-176785 7/1997
JP 9-176786 7/1997

* cited by examiner

MATERIAL 1
ASPECT RATIO = 506%

MATERIAL 2
ASPECT RATIO = 347%

MATERIAL 3
ASPECT RATIO = 300%

MARTENSITIC MATERIAL
PRIOR TO SPHERODIZING ANNEALING
X2. 1

PRIOR TO SPHERODIZING ANNEALING
SURFACE LAYER X 100

PRIOR TO SPHERODIZING ANNEALING
SURFACE LAYER AND INTERMEDIATE LAYER X 200

PRIOR TO SPHERODIZING ANNEALING
1/2 R PART X 400

PRIOR TO SPHERODIZING ANNEALING
CENTRAL PART X 400

MARTENSITIC MATERIAL
AFTER SPHERODIZING ANNEALING PATTERN 1
X2. 1

AFTER SPHERODIZING ANNEALING PATTERN 1
SURFACE LAYER X 100

AFTER SPHERODIZING ANNEALING PATTERN 1
SURFACE LAYER X 400

AFTER SPHERODIZING ANNEALING PATTERN 1
1/2 R PART X 400

MARTENSITIC MATERIAL
AFTER SPHERODIZING ANNEALING PATTERN 1
X2. 1

AFTER SPHERODIZING ANNEALING PATTERN 2
SURFACE LAYER X 100

AFTER SPHERODIZING ANNEALING PATTERN 2
SURFACE LAYER X 400

AFTER SPHERODIZING ANNEALING PATTERN 1
1/2 R PART X 400

SLIP TORQUE

S – N CURVE (ROTATIONAL BENDING FATIGUE TEST)

S – N CURVE (SOLID BENDING FATIGUE TEST)

| | BILLET MANUFACTURING PROCESS | | | | | ASPECT RATIO OF CARBIDE (%) | CRACK PERCENTAGE % N=100 |
|---|---|---|---|---|---|---|---|
| | SPHERODIZING ANNEALING PRIO TO DRAWING | DRAWING | CUTTING | SPHERODIZING ANNEALING SUBSEQUENT TO DRAWING | SHOT BONDERIZING | | |
| MATERIAL 1 | NONE | NONE | O | O | O | 506 | 35% |
| MATERIAL 2 | NONE | (20%) O | O | O | O | 347 | 5% |
| MATERIAL 3 | O | (20%) O | O | O | O | 300 | 0% |

ASPECT RATIO (%) =b/a X 100

FORMING DIE APPARATUS

This application is a Divisional of application Ser. No. 09/575,348, filed May 19, 2000, now abandoned, which application is incorporated herein by reference.

BACKGROUND OF THE INVENTION

1. Field of the Invention

The present invention relates to a billet for cold forging with high deformability and maintained hardenability, which can continuously be cold-forged without the need for process annealing, a technique for manufacturing such a billet for cold forging, a method of continuously cold-forging such a billet into a disk-shaped part with a shaft such as a connecting rod for an engine, and a cold-forging die apparatus.

2. Description of the Related Art

Heretofore, crankshafts and connecting rods for use in engines for motorcycles have mainly been manufactured by a hot forging process. It is the general practice to heat the material to a temperature equal to or higher than its recrystallization temperature and forge to shape.

Materials for use in the hot forging process include a thermally refined steel and a thermally unrefined steel. The thermally refined steel is a steel that has been heated to about 1200° C. and thereafter quenched and tempered for increased strength and toughness. A carbon steel that is used as the material of crankshafts is usually treated with heat.

The thermally unrefined steel is a steel with added vanadium that has been heated to about 1200° C. and thereafter air-cooled for increased strength and toughness.

Crankshafts have portions, i.e., worms and tapers, that are required to have a higher hardness than other portions thereof. The crankshafts need to contain carbon (C) in order to increase the hardness of these portions by subsequent induction hardening. Therefore, the material which is to be hot-forged into crankshafts is usually a carbon steel according to JIS S48C.

The carbon steel S48C is composed of 0.45–0.51 wt % of C, 0.15–0.35 wt % of Si, 0.6–0.9 wt % of Mn, 0.03 wt % or less of P, 0.035 wt % or less of S, 0.3 wt % or less of Cu, 0.2 wt % or less of Ni, and 0.2 wt % or less of Cr.

The carbon steel S48C has such cold forgeability that its upsetting ratio ranges from about 70 to 75%. If the carbon steel S48C were cold-forged at an upsetting ratio of 90% or more, then it would crack and fail to be deformed to desired shape.

The defonnability of the carbon steel S48C is affected by elements including Si, F, S, and Cu. Si is effective to increase the hardness and tensile strength of the steel and speed up the growth of crystal grain upon heat treatment, but tends to reduce stretchability and impact values for thereby impairing the forgeability of the steel. P in the form of a solid solution in ferrite also increases the hardness and tensile strength of the steel, but is liable to reduce impact values, making it easy for the steel to crack and cause cold brittleness. If the carbon steel S48C contains a large amount of S, then it precipitates manganese sulfide (MnS) that tends to start cracking when the steel is cold-forged, so that the steel is apt to crack when machined. If the carbon steel S48C contains a large amount of Cu, then the ferrite hardness increases to the extent that impairs the cold forgeability of the steel.

From the standpoint of keeping a desired level of hardenability, it is preferable to contain the same amount of C as with the above material for hot forging. Mn is also desirable to be contained in the same amount as with the above material for hot forging because Mn in the form of a solid solution in ferrite lowers the transformation temperature of the steel, allowing the steel to be easily quenched.

The hot-forging process is disadvantageous in that since die surfaces used tend to be easily worn, hot-forged products have poor dimensional accuracy and need to have a large finishing allowance to be removed when they are machined, and hence are machined with low efficiency. Furthermore, because hot-forged products have a large lathing allowance, the number of lathes required to machine the hot-forged products increases, resulting in a large amount of initial investments.

In addition, inasmuch as the material is hot-forged after it has been heated, scales are produced from the material during the hot-forging process. Furthermore, the hot-forging process makes it difficult to keep the working environment clean because the die surfaces need to be coated with a parting agent.

The cold-forging process is capable of solving the above problems with respect to the dimensional accuracy of forged products, the working environment, and the initial investments. However, the greatest problem of the cold-forging process is that the deformability of the material that is cold-forged is so small that the material tends to crack during the cold-forging process.

One conventional cold-forging process for manufacturing a crankshaft is shown in FIG. 25 of the accompanying drawings.

As shown in FIG. 25, the conventional cold-forging process is carried out by slowly cooling a rolled billet to soften the billet, deep-drawing and upsetting the billet while it is cold, thereafter softening the billet at an intermediate stage to remove strains introduced by the deep-drawing and upsetting steps, roughly shaping the billet into a crankshaft while it is cold, finally shaping the crankshaft while it is cold, removing an outer circumferential edge of the crankshaft while it is cold, forming a pin hole in the crankshaft while it is cold, and thereafter finishing the crankshaft by grinding the shank thereof and induction-hardening the crankshaft.

The conventional cold-forging process is liable to cause the billet to crack in the upsetting stage more frequently than the hot-forging process. To prevent the billet from cracking, the billet is softened in the intermediate stage to cancel strains developed so far in the cold-forging process. If the billet tends to be deformed greatly, then it is necessary to add more softening steps in the intermediate stage.

With softening steps introduced in the intermediate stage, however, the cold-forging process which would otherwise be continuous except for die changing is interrupted, and heat-treatment apparatus need to be installed to operate somewhere in the entire cold-forging process. Consequently, the cold-forging process is also problematic though the problems are not as serious as those of the hot-forging process.

It is an object of first and second inventions to provide a composition for a billet for cold forging which can continuously be cold-forged, i.e., does not need an intermediate softening step in the cold-forging process, and can well be hardened, and a method of manufacturing such a billet for cold forging.

An object of a third invention is to provide a method of manufacturing such a billet for cold forging with a simplified spheroidizing step required to manufacture a billet that can continuously be cold-forged.

In the manufacture of crankshafts for use in engines for motorcycles, there is a process of forming a split-type crankshaft in the form of a disk with shafts attached to both sides thereof, and connecting the split-type crankshaft with a pin. One conventional process of forming such a split-type crankshaft is disclosed in Japanese laid-open patent publication No. 58-215237, for example.

According to the disclosed process, a round bar is forged into a disk-shaped crank body with a shaft, and a counterweight is formed separately from the disk-shaped crank body. Then, the counterweight is integrally joined to the disk of the crank body.

However, the above process is disadvantageous in that the number of steps of the process is large because the crank body and the counterweight are separately formed and then joined to each other.

Furthermore, since the joining step is different from the respective steps of forming the crank body and the counterweight, the joining step needs a preparatory action for joining the crank body and the counterweight to each other.

If the crank body and the counterweight are produced by hot forging, then a grinding process for removing scales from the crank body and the counterweight and a machining process for achieving a desired level of dimensional accuracy are subsequently required. Therefore, the efficiency with which to produce the crank body and the counterweight is relatively low, resulting in a low yield of crankshafts.

It is an object of a fourth invention to provide a method of cold-forging a crankshaft without a machining step to remove scales for thereby increasing a yield and achieving a large cost reduction.

Objects of fifth, sixth, and seventh inventions are to provide a method of cold-forging a disk-shaped part with a shaft, a method of cold-forging a crankshaft, and a method of cold-forging a disk-shaped part with a shaft, respectively, to manufacture a disk shaped part with a shaft which has disk portions of different volumes, by eliminating different steps of forming the disk portions of different volumes separately and joining them to each other, for thereby doing away with the trouble of a preparatory action and increasing a yield.

Japanese laid-open patent publication No. 60-102245 discloses a known apparatus for forging crankshafts.

The disclosed forging apparatus forms splines on the shank of a split-type crankshaft by forging. Specifically, the shank of a split-type crankshaft whose overall shape has been formed by hot forging is set in a lower die, and the counterweight of the split-type crankshaft is pressed by a nib of an upper die to form splines on the shank with a tooth die in the lower die. The nib is divided into separate components, and a resilient member is held against rear surfaces of the nib components. Even when the nib presses a counterweight having a step, the resilient member applies uniform forces the counter-weight around the shank to prevent shank side end surfaces from being displaced.

Although the cold-forging process can solve the problems with respect to the dimensional accuracy of forged products, the working environment, and the initial investments, the cold-forging process is costly in that it places large burdens on dies and hence the dies have a relatively short service life. The nib that is divided into the components to accommodate the height of the counterweight is only effective to handle the existing counterweight, but not applicable to different counter weights that are to be produced.

It is an object of an eighth invention to provide a cold-forging die apparatus which will solve the above problems.

SUMMARY OF THE INVENTION

According to the first invention, a billet of steel for continuous cold forging is composed of 0.46–0.48 wt % of C, 0.14 or less of Si, 0.55–0.65 wt % of Mn, 0.015 wt % or less of P, 0.015 wt % or less of S, 0.15 wt % or less of Cu, 0.20 wt % or less of Ni, and 0.35 wt % or less of Cr.

The first invention is based on the composition of S48C that is a material for hot forging with the amount of C being equal to that in S48C for maintaining hardenability. According to the first invention, it has been determined how much Si, P, S, and Cu, which are liable to be responsible for material cracking in cold forging, has to be reduced, and the billet of the above composition for cold forging has been prepared based on the determined results.

It is preferable to manufacture the above billet for cold forging by, as with the second invention, spheroidizing a carbide in a bar-shaped blank in a first spheroidizing annealing step, thereafter drawing the blank at a predetermined sectional area reduction ratio, cutting the blank to a predetermined length, and thereafter promoting the dispersion of the internal carbide for an increased spheroidizing ratio in a second spheroidizing annealing step. The billet thus manufactured has reduced hardness, improved forgeability, and an increased surface-layer elongation ratio. The hardness of the cold-forged product can be increased by aging.

Through the above annealing steps, the carbide of the billet has an aspect ratio of 300% or less. The billet of the above composition has a limiting upsetting ratio of 90% or more.

For cutting the bar to a desired dimension, the bar should preferably be cut between the drawing step and the second spheroidizing annealing step.

In the first spheroidizing annealing step, the machinability of the blank in its entirety is increased so as to be able to give strains well inside the blank, and to make the pearlite finer. In the drawing step, the austenite grain produced by subsequent annealing is made finer for an increased spheroidizing rate. In the second spheroidizing annealing step, the carbide is dispersed for further increasing the spheroidizing rate.

By thus spheroidizing the billet structure, the billet can continuously be cold-forged. It is desirable to further simplify the step of spheroidizing the billet structure.

Specifically, the billet structure can be turned into a fine spheroidized structure by performing the spheroidizing annealing step before the drawing step and also performing the spheroidizing annealing step after the drawing step, i.e., performing two spheroidizing annealing steps, as with the second invention. From the standpoint of cost, the omission of a further step is desirable.

According to the third invention, a method of manufacturing a billet for cold forging is characterized by the steps of quenching a blank unloaded from a heating furnace to form a fine martensitic structure in a surface thereof, and then annealing the blank to convert the martensitic structure of the surface into a fine spheroidized structure comprising ferrite and cementite.

When annealed, the internal structure of the blank which has been of a mixed phase of ferrite and pearlite is spheroidized with the pearlite broken. Therefore, both the internal structure and the surface layer of the blank are spheroidized, resulting in extremely high deformability.

The blank may be annealed by holding the blank at about 740° C. for 6 hours, thereafter dropping the temperature to about 680° C. at a rate of 20° C./h, and thereafter cooling the blank in a furnace, or may be annealed by holding the blank at about 750° C. for 4 hours, then at about 735° C. for 3.5 hours, thereafter dropping the temperature to about 680° C. at a rate of 15° C./h, and thereafter cooling the blank in a furnace.

As with the second invention, the blank may appropriately be made of a carbon steel which is composed of 0.46–0.48 wt % of C (carbon), 0.14 or less of Si (silicon), 0.55 0.65 wt % of Mn (manganese), 0.015 wt % or less of P (phosphorus), 0.015 wt % or less of S (sulfur), 0.15 wt % or less of Cu (copper), 0.20 wt % or less of Ni (nickel), 0.35 wt % or less of Cr (chromium), and a remainder of Fe (iron) and impurities.

According to the fourth invention, a method of cold-forging a crankshaft from a billet formed by continuous cold forging is characterized by the first step of extruding the billet to form a multi-stepped shaft having at least two steps and contiguous to a main body, the second step of upsetting and drawing the formed workpiece to simultaneously increase the diameter of the main body and reduce the diameter of at least a portion of the multi-stepped shaft, the third step of upsetting and drawing the formed workpiece to simultaneously rough the main body to an asymmetrical shape and reduce the diameter of at least a portion of the multi-stepped shaft, the fourth step of pressing an asymmetrical boundary of the main body to simultaneously finish the main body and form a central hole axially centrally in the main body, and the fifth step of forming a pin hole in the main body at a predetermined position and removing an outer circumferential portion of the main body thereby to shape the main body.

By thus continuously cold-forging the billet, the diameter of the multi-stepped shaft is gradually reduced, and the main body, which will become a counter weight, is gradually upset into an asymmetrical shape. At this time, the elongation ratio of the material increases due to the heating of the material by the machining at a large deformation rate, and the initial deformability is maintained at the stage where many carbides, which start cracking, are present in the form of a solid solution in ferrite. By continuously cold-forging the billet in view of these features, the billet can be machined at a maximum upsetting ratio of about 92%.

If a right or left crankshaft is formed by a continuous cold-forging process, then scale removal and mechanical machining for achieving accuracy in subsequent steps are dispensed with, with the result that the yield is increased.

The billet for cold forging is preferably made of a carbon steel based on the composition of JIS S48C from which the contents of Si (silicon), P (phosphorus), and S (sulfur) that are liable to cause material cracking are reduced. If such a material is spheroidized by annealing, then drawn, and spheroidized by annealing again, then the cold forgeability is preferably increased.

Splines are formed on an end of said multi-stepped shaft in said fourth step.

By thus simultaneously forming splines, a mechanical machining process for forming splines can be dispensed with.

According to the fifth invention, a method of cold-forging a disk-shaped part with a shaft from a multi-stepped intermediate blank through a plurality of forging steps is characterized by forming an asymmetrical disk having left and right portions of different volumes with respect to an axial center of said intermediate blank.

By thus cold-forging the asymmetrical disk having the portions of different volumes, preparatory actions may be omitted, the manufacturing process is simplified, and a mechanical machining process for removing scales can be dispensed with, so that the yield is better than with hot forging. The billet for cold forging is preferably made of a carbon steel based on the composition of JIS S48C from which the contents of Si (silicon), P (phosphorus), and S (sulfur) that are liable to cause material cracking are reduced. If such a material is spheroidized by annealing, then drawn, and spheroidized by annealing again, then the cold forgeability is preferably increased.

The ratio of the volumes of the left and right portions of said disk is about 1:2. With the volume ratio thus selected, the method is optimum for the manufacture of a counterweight of a crankshaft.

According to the fifth invention, in order to achieve the different volumes, inclined surfaces having different angles of inclination are formed across a junction between the left and right portions which extends from the shaft of the blank to the disk. The angle of inclination of the portion having the greater volume is smaller than the angle of inclination of the portion having the smaller volume.

By thus forming the inclined surfaces having different angles of inclination across the junction between the left and right portions which extends from the shaft of the blank to the disk, the left and right angles of friction differ from each other when the disk is upset axially, making it possible to make the material flow differently in the left and right portions.

In the case where the angle of inclination of the portion having the greater volume is smaller than the angle of inclination of the portion having the smaller volume, the material is less likely to flow toward the greater angle of inclination, but more likely to flow toward the smaller angle of inclination. Therefore, the disk-shaped part with the shaft can be formed without material cracking and without being subjected to an excessive load.

The left and right angles of inclination are appropriately established depending on the desired volume ratio, so that a desired volume difference will be produced by upsetting or the like.

According to the sixth invention, a method of cold-forging a crankshaft is characterized by continuously cold-forging a blank made of a carbon steel which is composed of 0.46–0.48 wt % of C, 0.14 or less of Si, 0.55–0.65 wt % of Mn, 0.015 wt % or less of P, 0.015 wt % or less of S, 0.15 wt % or less of Cu, 0.20 wt % or less of Ni, 0.35 wt % or less of Cr, and a remainder of Fe and impurities, thereby to produce a crankshaft, and thereafter aging the crankshaft (e.g., at a temperature ranging from 250 to 350° C. for 1 to 2.5 hours).

According to the seventh invention, a method of cold-forging a disk-shaped part with a shaft is characterized by holding the shaft of the cold-forged disk-shaped part with a lower support base of a forming die, lowering an upper die assembly to hold the disk of the disk-shaped part between the lower support base and an upper support base and lower the disk-shaped part by a predetermined stroke, punching a hole in a predetermined region of the disk with a punch of a lower die assembly, and thereafter lowering the upper die assembly to cause an upper die to remove an outer circumferential portion of the disk.

Since the hole is formed in the disk and the outer circumferential portion is removed from the disk at the same time, the process is simplified for increased productivity.

Because the disk-shaped part with the shaft is formed by continuous cold forging, a mechanical machining process for removing scales after hot forging is dispensed with, and hence the process is further simplified.

Inasmuch as the hole is punched based on the shaft of the disk-shaped part, the hole can be formed with good accuracy, and the outer circumferential portion can be removed from the disk with good balance, so that a mechanical machining process for retaining accuracy can be dispensed with.

If the disk-shaped part with the shaft comprises a split-type crankshaft, then the hole formed by the punch is a pin hole, and the outer circumferential portion removed from the disk is a burr which is formed when the disk-shaped part is forged.

According to the seventh invention, the method is characterized by accommodating a scrap removed by the punch in a receptacle in the upper support base, holding a scrap removed by the upper die between the lower die assembly and the upper die, and thereafter, when the upper die assembly is lifted, placing the scraps into original positions thereof in the disk, and discharging the scraps when the disk-shaped part is ejected.

Since the scraps are returned to their original positions and then discharged, it is not necessary for the die assemblies to have scrap discharge passages, and the scraps can be discharged quickly.

A forming die apparatus for simultaneously forming a hole in a predetermined region of a disk of a disk-shaped part with a shaft which has been cold-forged, and removing an outer circumferential portion of the disk is characterized by a lower support base vertically movable by a predetermined stroke for holding the shaft of the disk-shaped part, a punch fixed to a lower die assembly, an upper support base for holding the disk of the disk-shaped part in coaction with the lower die assembly in response to downward movement of the upper die assembly, and an upper die vertically movable with respect to said upper support base, the arrangement being such that while the disk-shaped part with the shaft is being lowered the predetermined stroke upon downward movement of the upper die assembly, a hole is formed in the disk by the punch, and upon further downward movement of the upper die assembly, the downward movement of the disk shaped part with the shaft stops and the outer circumferential portion of the disk is removed by the upper die.

According to the eighth invention, a cold forging die apparatus for upsetting a blank for cold forging between a punch and a die is characterized in that said punch has a nib and a reinforcing ring fitted around said nib, said nib being split into an inner nib and an outer nib which are held in interfitting relationship to each other, by a split surface which is located in the vicinity of a boundary between a region where radial stresses mainly act and a region where axial stresses mainly act when the blank is upset.

If stresses in different directions act on the nib, then if the nib is of a unitary structure, tensile stresses are produced in a region of the nib which corresponds to the boundary between these stresses in different directions, tending to cause the nib to crack.

By splitting in advance the region of the nib which corresponds to the boundary between these stresses in different directions, the stresses in the region are reduced, and the die service life is extended.

If the boundary between the stresses in different directions is located at the split surface between the inner nib and the outer nib, then a step is produced on the nib, and transferred to the cold-forged product.

To avoid the above drawback, the inner nib where axial stresses mainly act when the blank is upset preferably has an axial dimension selected such that the inner nib projects axially beyond the outer nib, in view of an axial deformation caused when the blank is upset.

The cold-forging die apparatus is suitable for use in forming a counterweight of a crankshaft. However, the cold-forging die apparatus is also applicable to the manufacture of other products.

BRIEF DESCRIPTION OF THE DRAWINGS

FIG. 12(*b*) is a diagram produced based on the photographic representation of FIG. 12(*a*), including different portions whose metal structures are shown in FIGS. 13 through 16;

FIG. 17(*b*) is a diagram produced based on the photographic representation of FIG. 17(*a*), including different portions whose metal structures are shown in FIGS. 18 through 20;

FIG. 21(*b*) is a diagram produced based on the photographic representation of FIG. 21(*a*), including different portions whose metal structures are shown in FIGS. 22 through 24;

FIG. 29(*b*) is a view of a workpiece processed by the first step of the methods of cold-forging a crankshaft according to the fourth and fifth inventions;

DETAILED DESCRIPTION OF THE PREFERRED EMBODIMENTS

Figure 1:
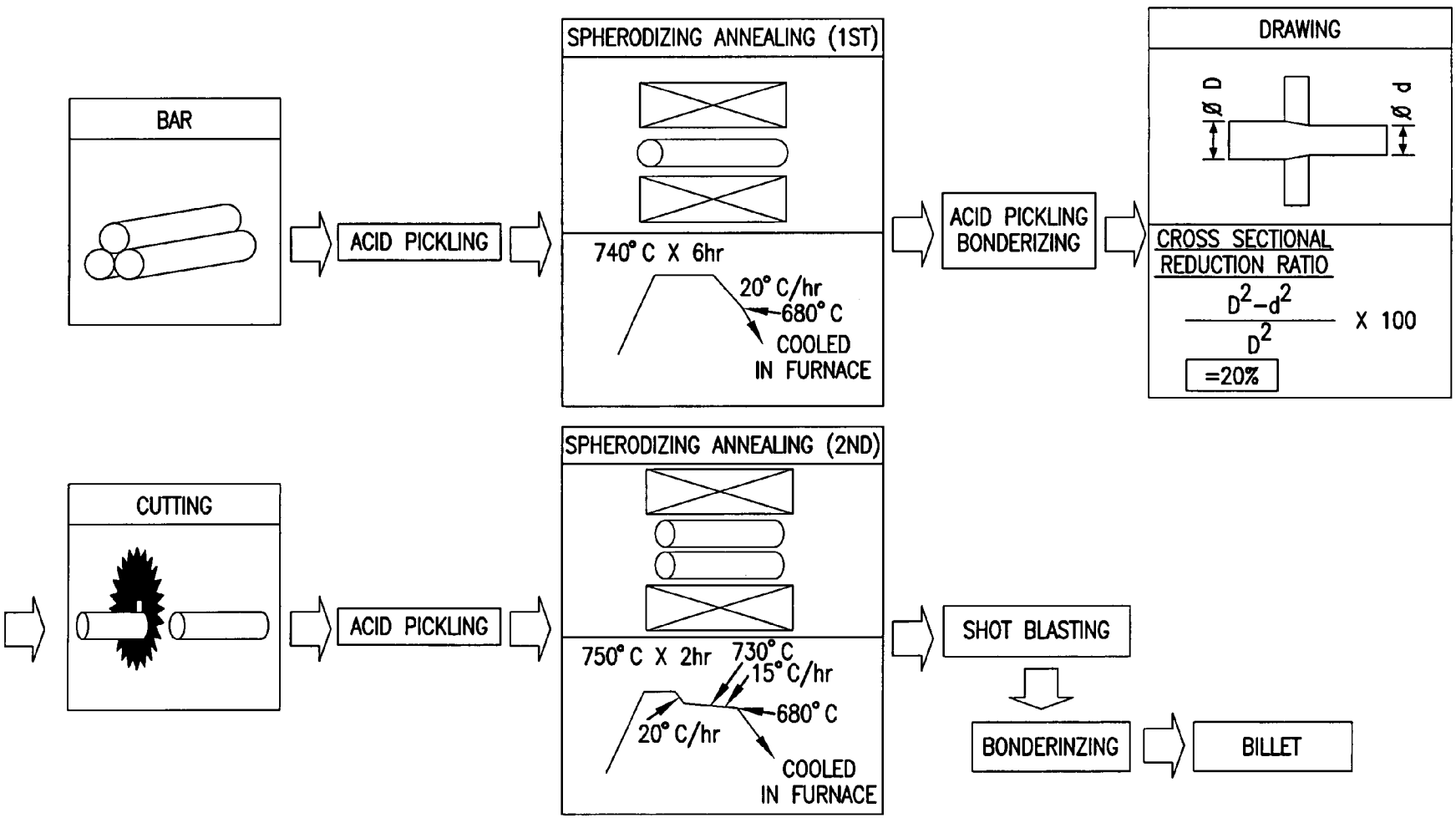
FIG. 1 is a diagram illustrative of a method of manufacturing a billet for cold forging from a round bar of material constituents according to a first invention and a method of manufacturing a billet for cold forging according to a second invention.

First and second inventions will be described below with reference to FIGS. 1 through 9. Billets according to the first and second inventions are made of a steel which is composed of 0.46–0.48 wt % of C, 0.14 or less of Si, 0.55–0.65 wt % of Mn, 0.015 wt % or less of P, 0.015 wt % or less of S, 0.15 wt % or less of Cu, 0.20 wt % or less of Ni, and 0.35 wt % or less of Cr. The composition is basically based on the composition of the steel S48C which is a material for hot forging, with the amount of C for maintaining hardenability being equivalent to that of the steel S48C and the amounts of Si, P, S responsible for cracking being reduced.

C is an element most effective for cold forgeability per unit %, and is important from the standpoint of mechanical properties, particularly, material strength and hardenability. Specifically, crankshafts require a certain mechanical strength in their entirety and also require high hardness in local regions including worms and tapers. For quenching those local regions after being forged to achieve increased hardness, it is necessary to set the proportion of C to the range from 0.46 to 0.48 wt %.

Si is present in pig iron as a raw material, and removed almost entirely in the steelmaking process. However, it may be added as a deoxidizer in a final stage of the steelmaking process. The steel S48c contains 0.15 to 0.35 wt % of Si, which is partly in the form of a solid solution in ferrite in the steel. Since Si impairs forgeability, its amount as a cold forging constituent should be as little as possible, and should be at most 0.14 wt %.

Mn remains somewhat in the steelmaking process. Since it is added as a deoxidizer, the steel S48C contains 0.60 to 0.90 wt % of Mn. Mn is bonded to S, and dispersed as manganese sulfide in the steel. It is partly in the form of a solid solution in ferrite. Mn that tends to be bonded to S becomes MnS. Since MnS is liable to start cracking in the forging process, it is preferable to reduce the amount of MnS. However, Mn in the form of a solid solution in ferrite allows the steel to be quenched easily, inhibiting the growth of crystal grain. Therefore, the amount of Mn is included in the range from 0.55 to 0.65 wt %.

P forms a solid solution in ferrite. If a large amount of P is included, then it is combined with part of the iron, forming iron phosphide. Since P in the form of a solid solution in ferrite reduces the elongation of the ferrite and also reduces impact values at normal temperature, it tends to cause cracking upon machining.

P is allowed to be contained up to 0.03 wt % in the steel S48C, but the allowed amount is too high as a cold forging constituent. The proportion of P is set to at most 0.015 wt %.

S is combined with part of Mn, forming MnS, which tends to start cracking in the forging process. While MnS is allowed to be contained up to 0.035 wt % in the steel S48C, the allowed amount is too high as a cold forging constituent.

According to the present invention, in order to minimize the contents of elements that impair the machinability, i.e., Si, P, S, for increased cold forgeability, Si is set to 0.14 wt % or less, P to 0.015 wt % or less, and S to 0.015 wt % or less.

When Cu is heated to a high temperature, it is less oxidized than Fe, and enriched in the surface, causing red brittleness. Therefore, a substantially equal amount of Ni is added to prevent red brittleness. Furthermore, a small amount of Cu that is contained is considered to increase ferrite hardness, impairing cold forgeability. Therefore, Cu is set to 0.15 wt % or less.

In addition to the above effect, Ni increases hardenability, prevents low-temperature brittleness, and improves corrosion resistance. Ni is added in the same amount as in the steel S48C. Since Cr increases hardenability and tempering resistance and also increases corrosion resistance tending to produce a stable carbide, Cr is added in the same amount as in the steel S48C.

For cold forging the material of the above constituents, a billet is prepared. First, the material is subjected to a first spheroidizing annealing process to spheroidize the internal carbide, and thereafter drawn at a predetermined sectional area reduction ratio and then cut to a desired dimension. Then, the material is subjected to a second spheroidizing annealing process to promote the dispersion of the internal carbide for an increased spheroidizing ratio. In this manner, the hardness is lowered for better machinability and a higher surface layer elongation ratio.

Specifically, as shown in FIG. 1, a bar of the steel material composed of the above constituents was subjected to acid pickling, and thereafter subjected to the first spheroidizing annealing process for thereby spheroidizing the cementite to increase the machinability of the entire material, to be able to give strains well inside the bar, and to make the pearlite finer.

In the first spheroidizing annealing process, the bar was held at 740° C. for 6 hours, and thereafter the temperature was dropped to 680° C. at a rate of 20° C./h, after which the bar was cooled in the furnace.

Figure 2:
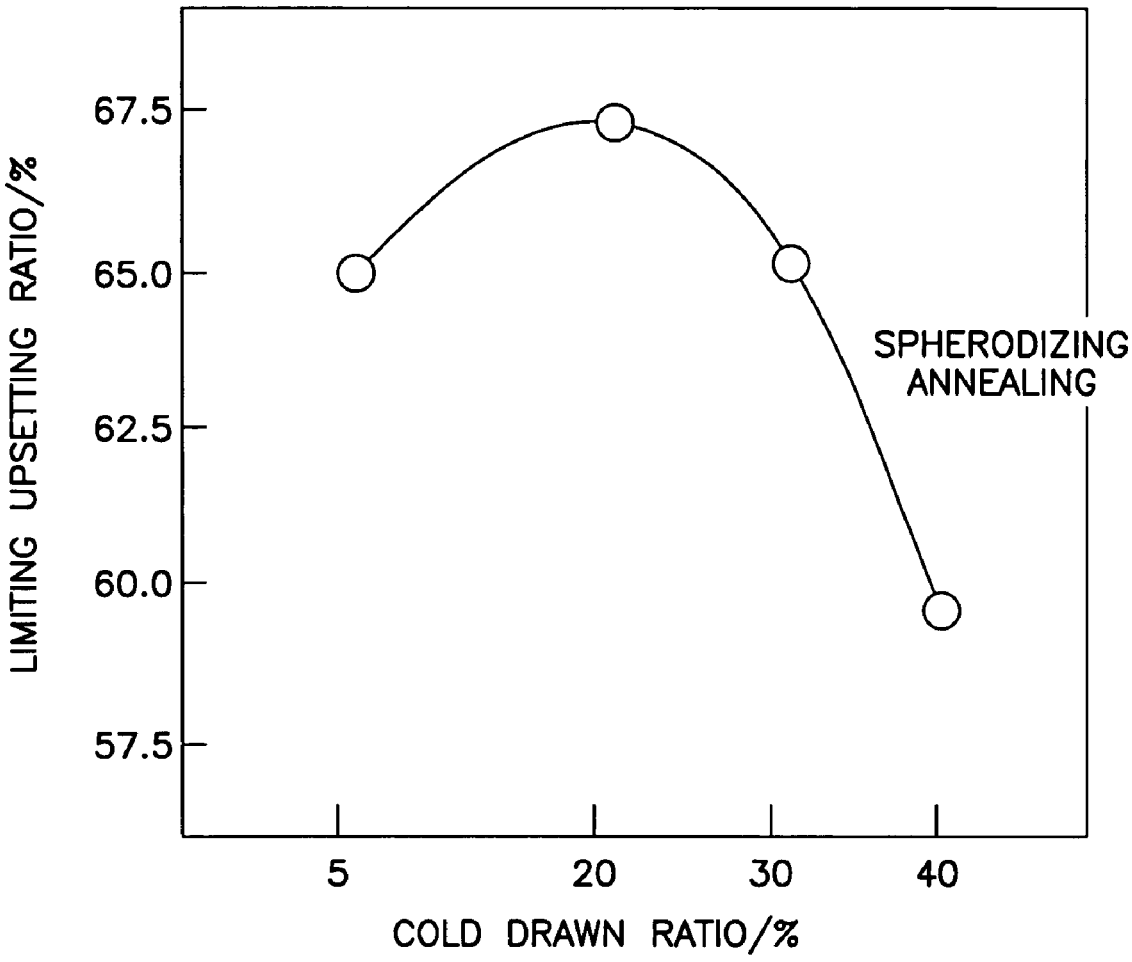
FIG. 2 is a graph showing the relationship between a cold drawing ratio and a limiting upsetting ratio.

Then, the bar was pickled in an acid, bonderized, and drawn for an increased limiting upsetting ratio. FIG. 2 is a graph showing the relationship between the cold drawing ratio (sectional area reduction ratio) of the spheroidized steel and the limiting upsetting ratio thereof. It can be seen from FIG. 2 that the limiting upsetting ratio is maximized when the cold drawing ratio (sectional area reduction ratio) is about 20%. This fact has heretofore been known in the art.

The reason why the limiting upsetting ratio increases by the drawing process is believed to be that when the bar is drawn, the austenite grain is made finer upon annealing, making it possible to increase the spheroidizing rate. In this embodiment, the bar was drawn at the cold drawing ratio (sectional area reduction ratio) of about 20% in order to achieve the maximum limiting upsetting ratio.

As shown in FIG. 1, the cold drawing ratio (sectional area reduction ratio) is a value represented by $(D_2-d_2)/D_2\times100$ where D is the diameter of the bar before it is drawn and d the diameter of the bar after it is drawn.

Then, the bar was cut to a desired dimension, and pickled in an acid, after which the bar was subjected to the second spheroidizing annealing process to disperse the carbide and increase the spheroidizing ratio.

In the second spheroidizing annealing process, as shown in FIG. 1, the bar was held at 750° C. for 2 hours, and thereafter the temperature was dropped to 730° C. at a rate of 20° C./h, and then the temperature was dropped to 680° C. at a rate of 15° C./h, after which the bar was cooled in the furnace.

After the second spheroidizing annealing process, the surface of the bar was adjusted by shot blasting and bonderizing, thus producing a billet for cold forging.

Figure 3A:
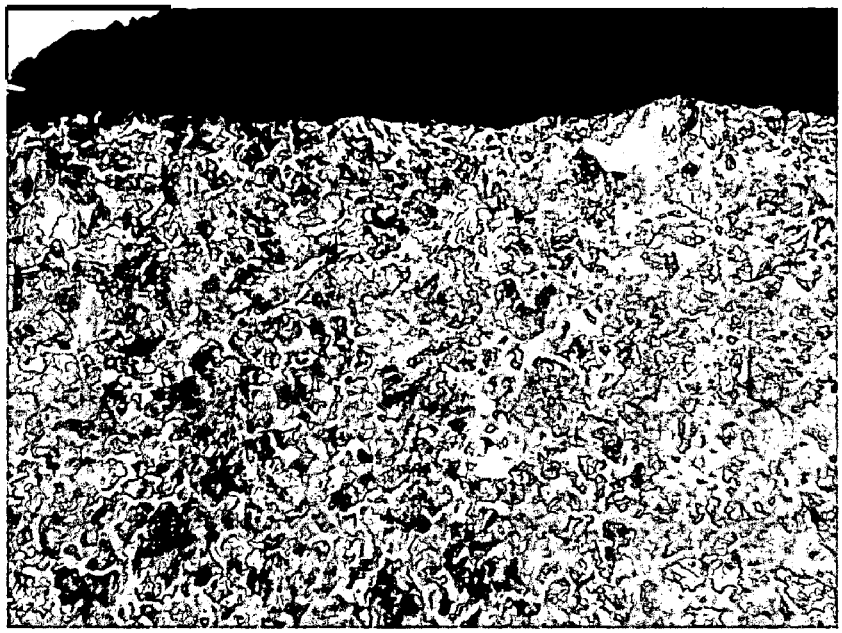
FIGS. 3(*a*) and 3(*b*) are microscopic photographic presentations of the metal structure of a round bar at respective magnifications of 100 and 400.
Figure 3B:
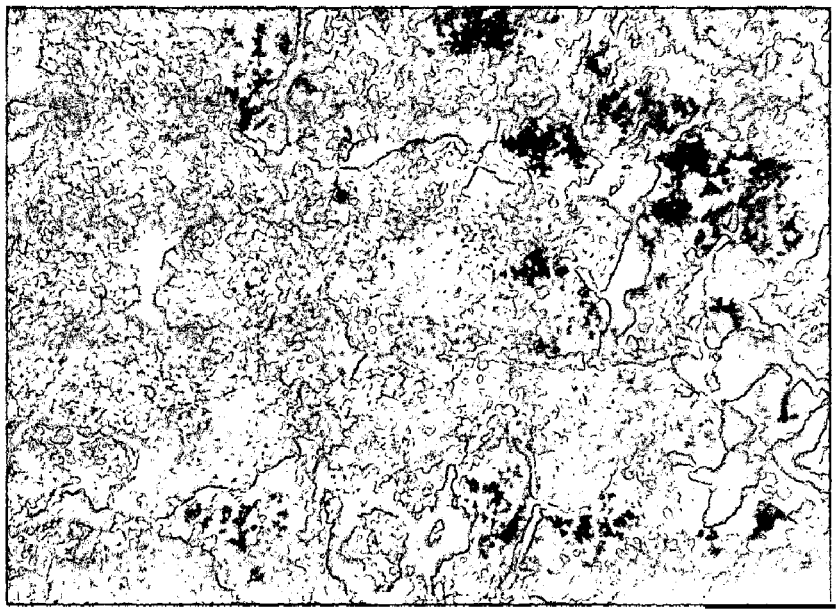
Figure 4A:
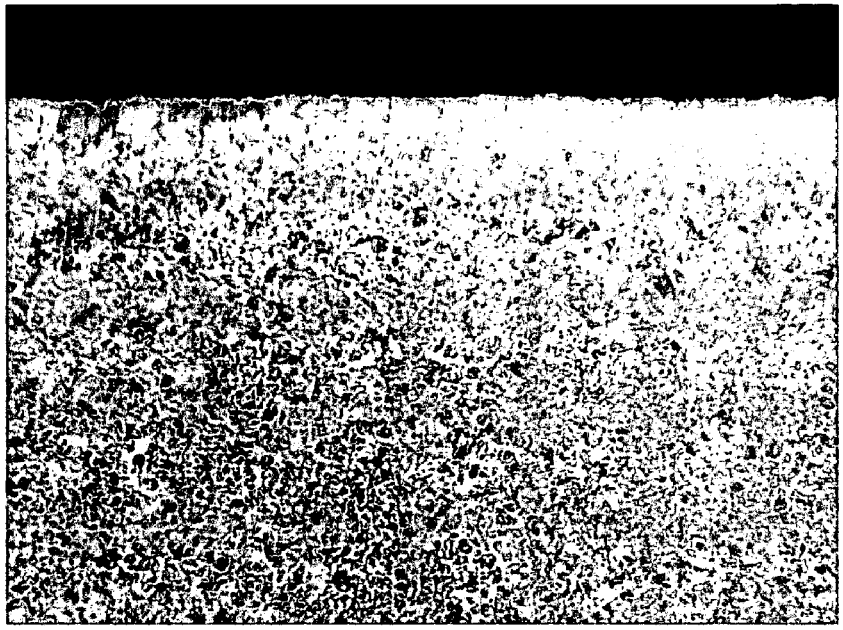
FIGS. 4(*a*) and 4(*b*) are microscopic photographic presentations of the metal structure of a billet produced when it is spheroidized after being drawn, but not spheroidized before being drawn, at respective magnifications of 100 and 400.
Figure 4B:
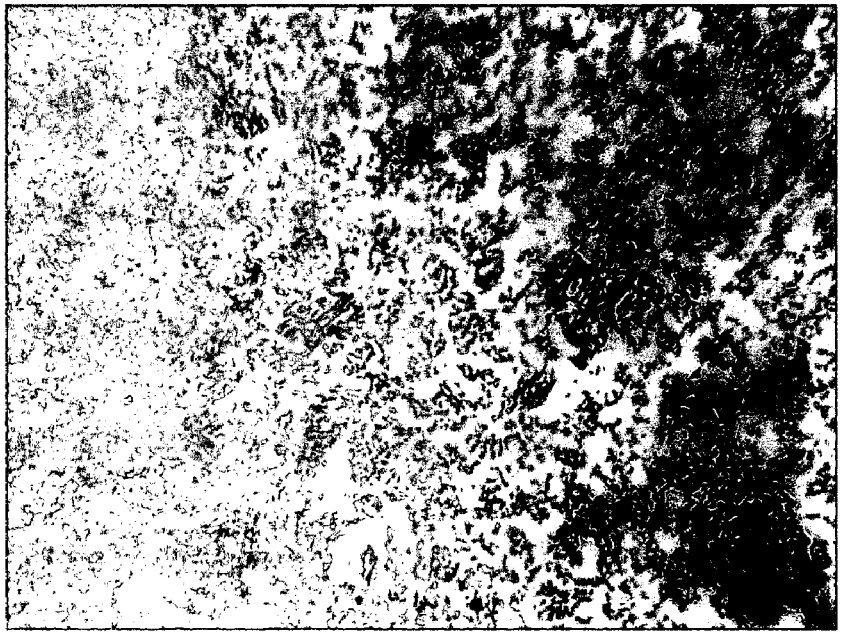
Figure 5A:
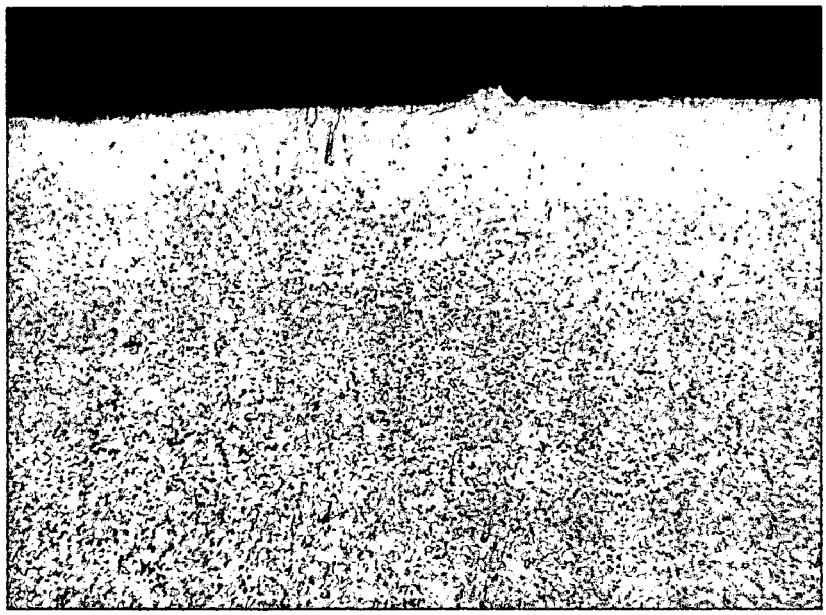
FIGS. 5(*a*) and 5(*b*) are microscopic photographic presentations of the metal structure of a billet produced when it is spheroidized before and after being drawn, at respective magnifications of 100 and 400.
Figure 5B:
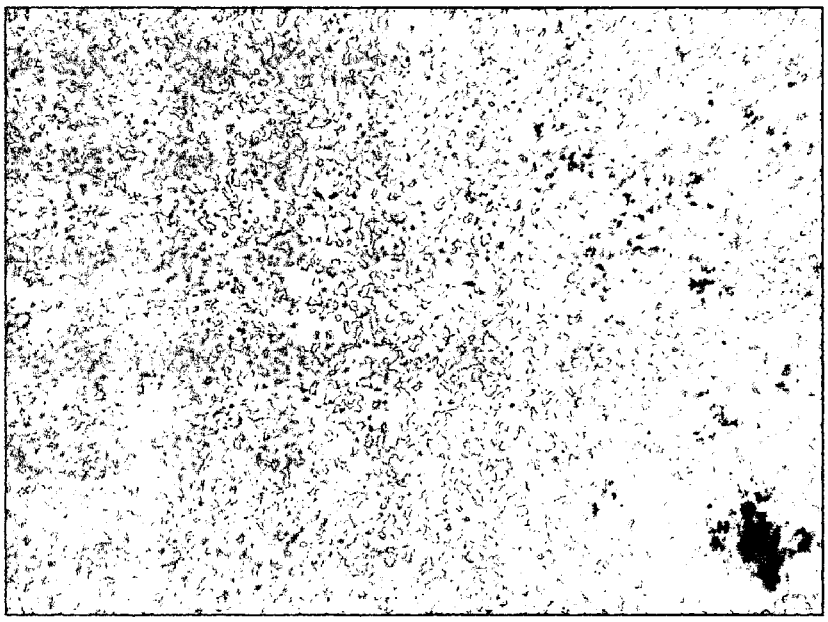

FIGS. 3 through 5 show differences of metal structures of the bar and the billet which has been refined by the above drawing and spheroidizing annealing steps.

FIGS. 3(*a*) and 3(*b*) are microscopic photographic presentations of the metal structure of a round bar at respective magnifications of 100 and 400. FIGS. 4(*a*) and 4(*b*) are microscopic photographic presentations of the metal structure of the billet produced when it is spheroidized after being drawn, but not spheroidized before being drawn, at respective magnifications of 100 and 400. FIGS. 5(*a*) and 5(*b*) are microscopic photographic presentations of the metal structure of a billet produced when it is spheroidized before and after being drawn, at respective magnifications of 100 and 400.

As can be seen from the photographic presentations of the metal structures shown in FIGS. 3 through 5, the billet which has not been spheroidized before being drawn has carbide spheroidized, but a pearlite structure remaining, as compared with the round bar, but the billet which has been spheroidized before and after being drawn has fine carbide dispersed, indicating that the two spheroidizing steps before and after the drawing step are effective.

The increase in the spheroidizing level (as its numerical value is smaller, a more spherical shape is achieved) and the reduction in the billet hardness are effective to make forgeability better, and the penetration of the decarburized layer (ferrite surface layer) depth is effective in increasing the elongation ratio of the surface layer.

Different materials were experimented for an aspect ratio. The materials were composed of 0.46–0.48 wt % of C, 0.14 or less of Si, 0.55–0.65 wt % of Mn, 0.015 wt % or less of P, 0.015 wt % or less of S, 0.15 wt % or less of Cu, 0.20 wt % or less of Ni, 0.35 wt % or less of Cr, and a remainder of Fe and impurities.

Figure 6A:
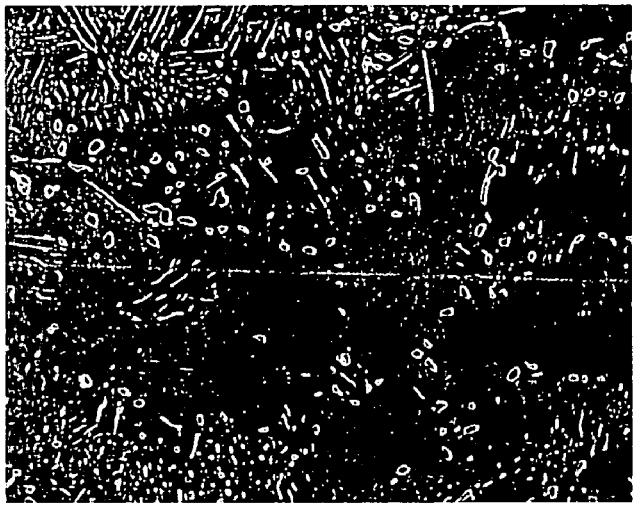
FIGS. 6(A) through 6(C) are SEM photographic presentations of the metal structures of billets at a magnification of 1,000.
Figure 6B:
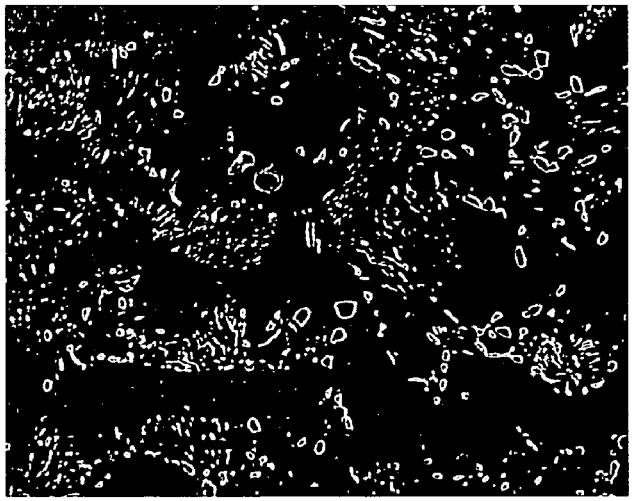
Figure 6C:
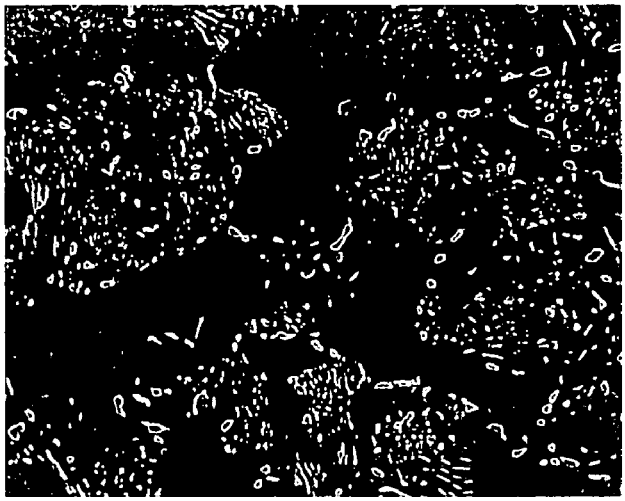

The metal structures of the material 1 which was spheroidized without being drawn, the material 2 which was not spheroidized before being drawn at a drawing ratio of 20%, and the material 3 which was spheroidized before and after being drawn at a drawing ratio of 20% are shown in FIGS. 6(A) through 6(C) at a magnification of 1000.

Figure 49:
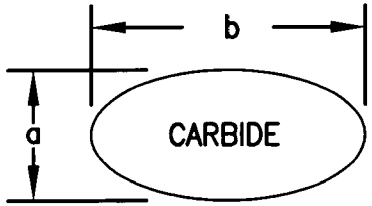
FIG. 49 is a table and illustration providing aspect ratio representing the spheroidized ratio of carbide for materials 1, 2 and 3.

As shown in FIG. 49, the aspect ratio (b/1×100) representing the spheroidized ratio of carbide in each of the materials was 506% for the material 1, 347% for the material 2, and 300% for the material 3.

Figure 8:
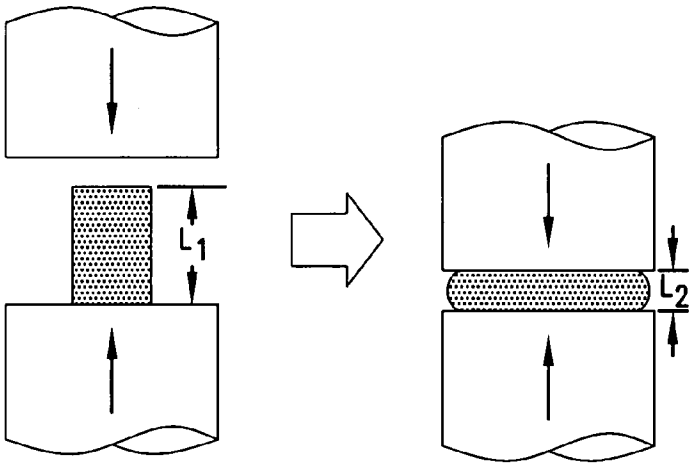
FIG. 8 is a view illustrative of an upsetting ratio.

Each of the materials was cold-forged (upset) at an upsetting ratio of $(L_1-L_2)/L_1\times100=90$ (%), as shown in FIG. 8. The percentages of cracks of the materials were 35%, 5%, and 0%, respectively.

It has been found that by carrying out two spheroidizing annealing steps, the carbide crystal becomes more spherical in shape, making the materials more resistant to cracking upon cold forging.

In order to confirm the effectiveness of the material constituents according to the present invention, the results of an upsetting test are shown in Table 1 below. The upsetting ratio was 90%, and the materials (billets) used in the upsetting test were spheroidized before and after being drawn.

Table 1

When the upsetting test was conducted on the steel S48G, the percentage of cracks that occurred was 20% (N=100). The crack occurrence percentage of 20% is not suitable for a material for cold forging.

The inventors attempted to reduce the proportion of Mn. As a result, the crack occurrence percentage reduced to 12%. However, this crack occurrence percentage is still not suitable for a material for cold forging. Since the steel S48C contains Mn at a proportion ranging from 0.60 to 0.90 wt %, the steel 548C and the material in which the proportion of Mn was reduced overlap each other in the range from 0.60 to 0.65 wt %. This is because the proportion of Mn cannot strictly be specified, but some variations are inevitable for the proportion of Mn. Such variations of the proportion of Mn are acceptable because some billets made of S48C do not crack and some billets made of the material in which the proportion of Mn is reduced crack.

Since it was found that reducing the proportion of Mn is not sufficient, the inventors then reduced the amount of C (carbon) to the extent that hardenability would not be adversely affected. As a result, the crack occurrence percentage reduced to 5%. However, this crack occurrence percentage is still not suitable for a material for cold forging.

The inventors then reduced the contents of elements that were considered to impair the machinability, i.e., Si, P, S, and Cu, and conducted an upsetting test on the resultant material. Specifically, Si was set to 0.14 wt % or less, P to 0.015 wt % or less, S to 0.015 wt % or less, and Cu to 0.015 wt % or less. As a result, the crack occurrence percentage was 0% as shown in Table 2.

Figure 7:
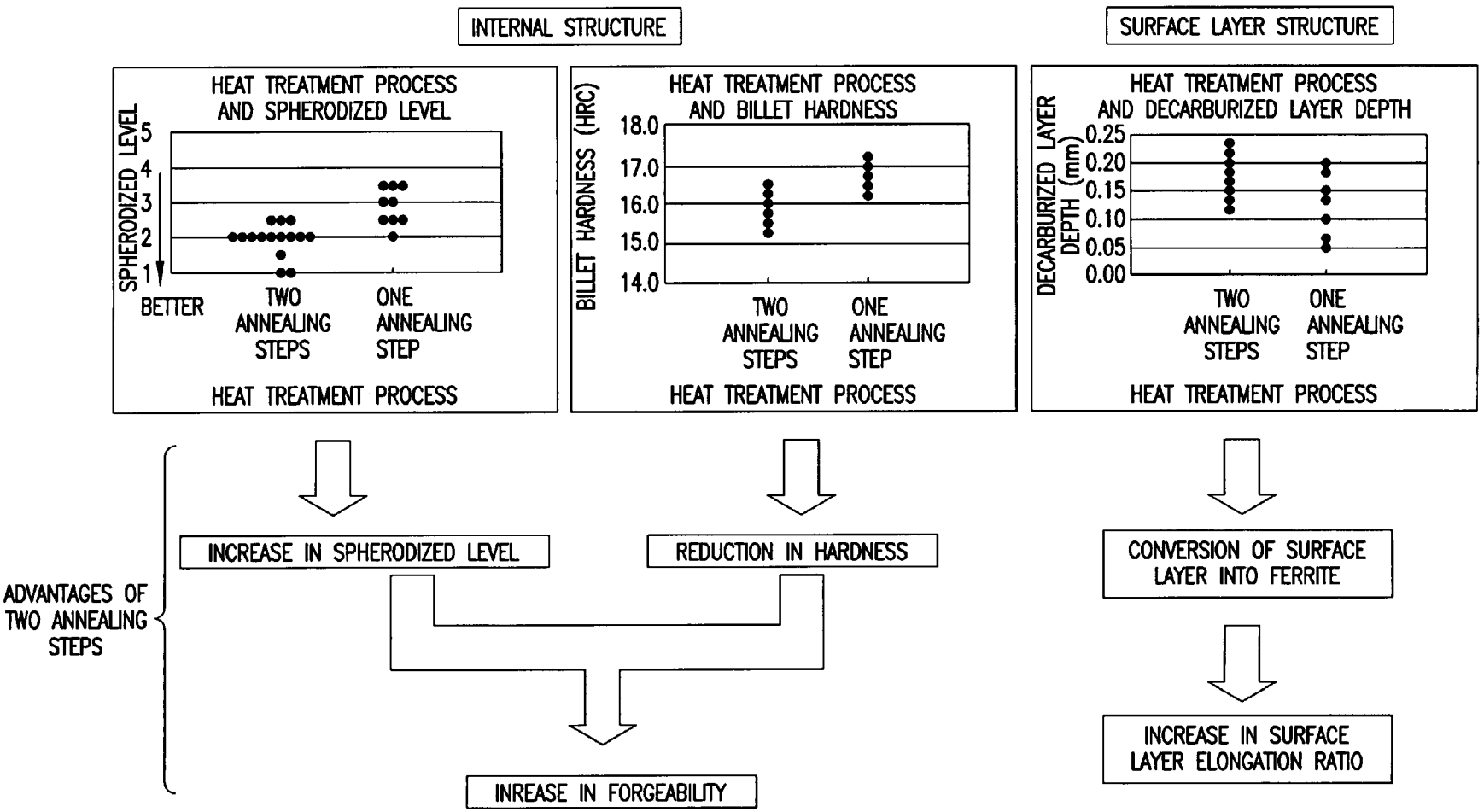
FIG. 7 is a diagram illustrative of effects produced by spheroidizing a billet before it is drawn.

The spheroidizing level, the billet hardness (HRC), and the decarburized layer depth (mm) achieved by one spheroidizing annealing step and two spheroidizing annealing steps were compared as shown in FIG. 7.

The increase in the spheroidizing level (as its numerical value is smaller, a more spherical shape is achieved) and the reduction in the billet hardness are effective to make forgeability better, and the penetration of the decarburized layer (ferrite surface layer) depth is effective in increasing the elongation ratio of the surface layer.

Each of the materials was subjected to an upsetting test, and the results of the test are as shown in Table 1 above. As shown in FIG. 8, the upsetting test was conducted at an upsetting ratio of $(L_1-L_2)/L_1\times100=90$ (%). As a consequence, cracks occurred when no spheroidizing annealing was performed before being drawn, and no cracks occurred when spheroidizing annealing was performed before and after being drawn if the drawing ratio was in the range from 18% to 20%.

It was confirmed that the upsetting limit when no spheroidizing annealing was performed before being drawn was in the range from 70 to 75% whereas the upset ting limit when spheroidizing annealing was performed before and after being drawn was 90% or higher. Therefore, the invention has proven effective.

Figure 9:
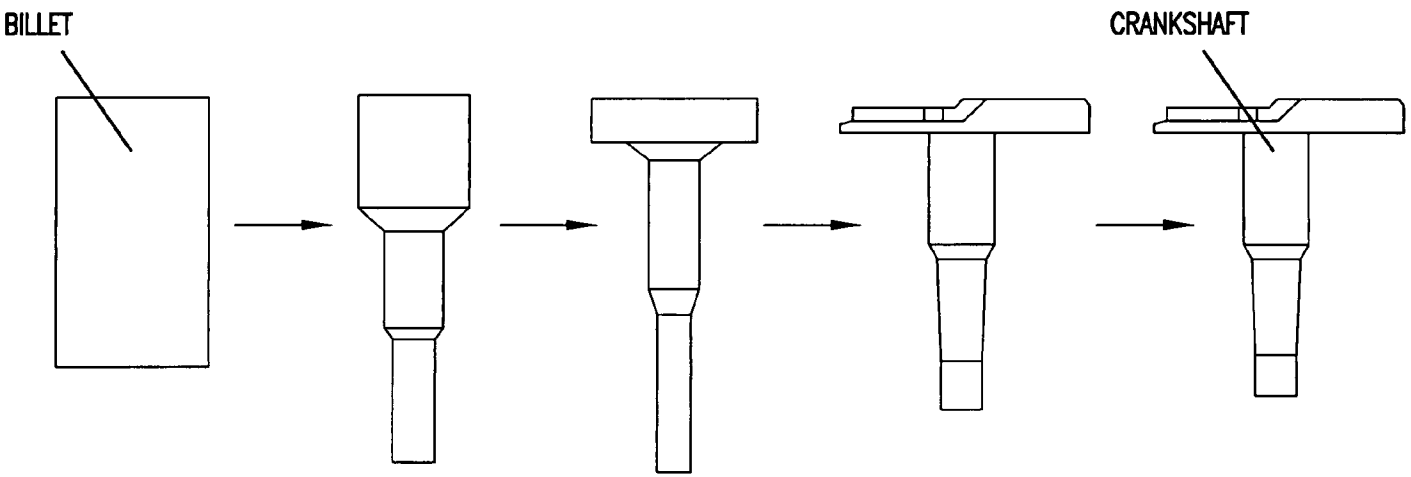
FIG. 9 is a view showing a forging process for continuously forging a billet for cold forging into a crankshaft.

If a crankshaft is produced by continuously cold-forging the billet thus prepared through a plurality of stages as shown in FIG. 9, then the crankshaft can continuously be formed without an intermediate annealing step during the forging process, and the hardenability of the crankshaft is good.

Figure 26:
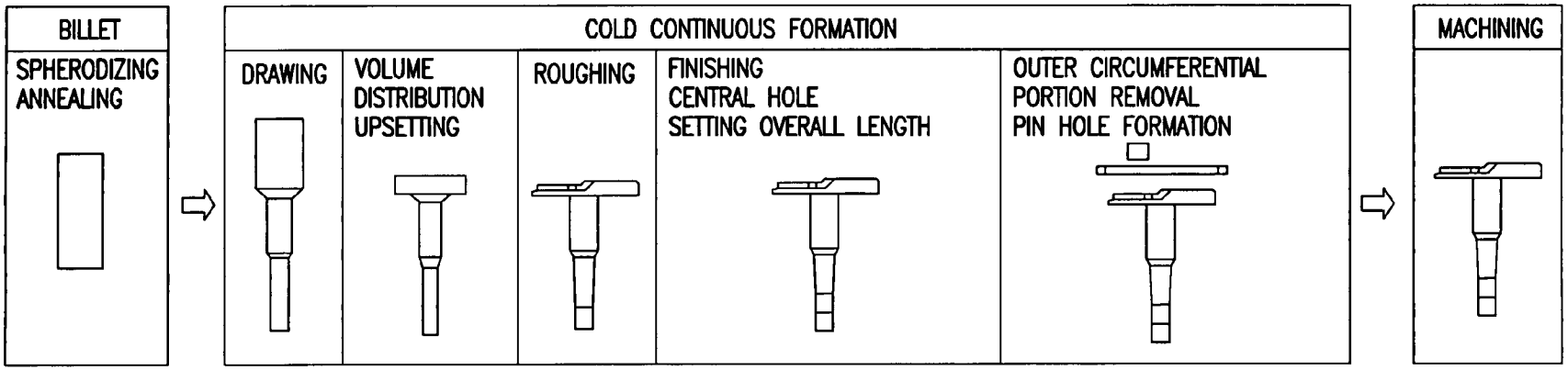
FIG. 26 is a diagram illustrative of a cold-forging process which results from the conventional cold-forging process by removing a softening step in an intermediate stage therefrom, the cold-forging process being made possible by using a billet manufactured by the method according to the third invention and a method proposed by the applicant.

As shown in FIG. 1, a billet produced by being rolled is pickled in an acid, subjected to the first spheroidizing annealing process, and then pickled in an acid and bonderized. Thereafter, the billet is drawn and cut, and then subjected to the second spheroidizing annealing process. In this manner, a series of cold forging steps including deep drawing, upsetting, roughing process, finishing process, outer edge removal, and pin hole forming can be carried out without the need for an intermediate softening step, as shown in FIG. 26. However, it is necessary to perform a total of two spheroidizing annealing steps before and after the drawing step. It is desirable to further reduce the number of manufacturing steps from the standpoint of cost.

Figure 10:
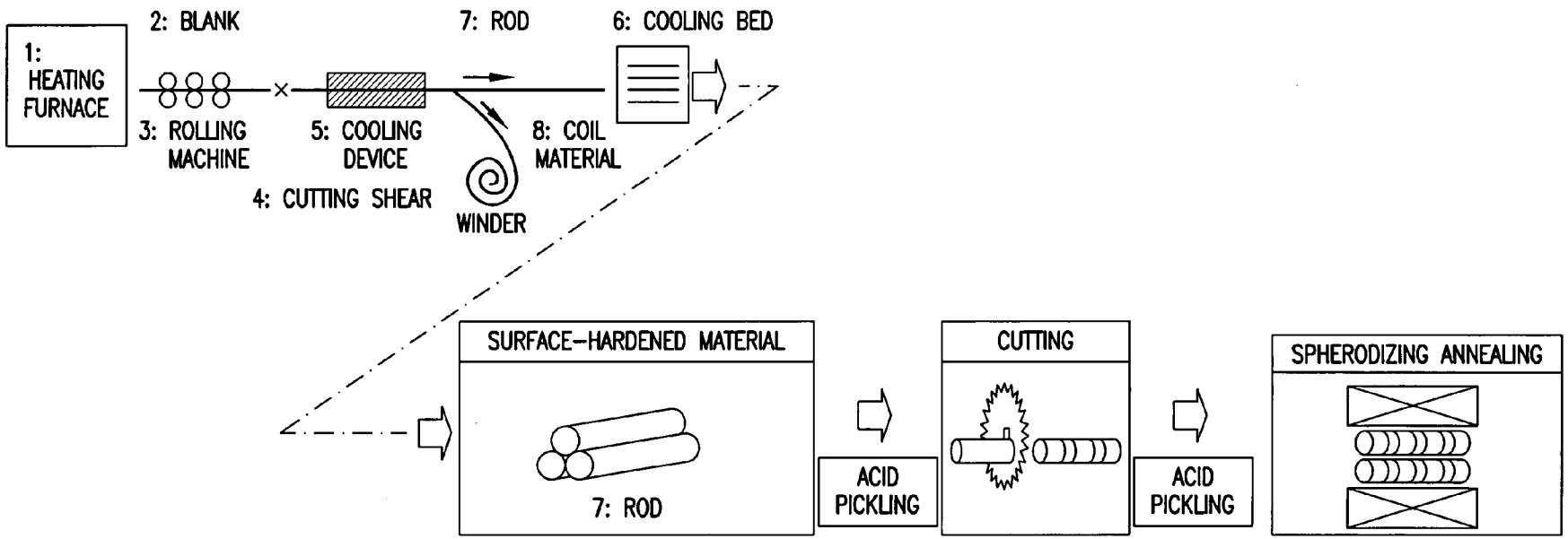
FIG. 10 is a diagram illustrative of a method of manufacturing a billet for cold forging according to a third invention.

According to a third invention, only one spheroidizing annealing step is involved. The third invention will be described below with reference to FIGS. 10 through 24. FIG. 10 is a diagram illustrative of a method of processing a billet for cold forging according to the third invention. According to the third invention, a blank 2 unloaded from a heating furnace 1 is rolled by a rolling machine 3, cut to a desired dimension by a cutting shear 4, and thereafter quenched in a cooling device 5. Thereafter, the blank is divided into a billet (rod) 7 or a coil material 8. The billet 7 is fed into a cooling bed 6, and the coil material 8 is wound.

The billet 7 or the coil material 8 is of a highly hard martensitic structure in its surface. The billet 7 or the coil material 8 which is of a highly hard martensitic structure in its surface is cut, pickled in an acid, and then subjected to spheroidizing annealing.

When the surface of the blank is quenched in the cooling device 5, it has heretofore been difficult to wind the coil material. By quenching the blank under optimum cooling conditions, it is possible to obtain the coil material 8 with a martensitic structure formed in its surface.

Figure 11A:
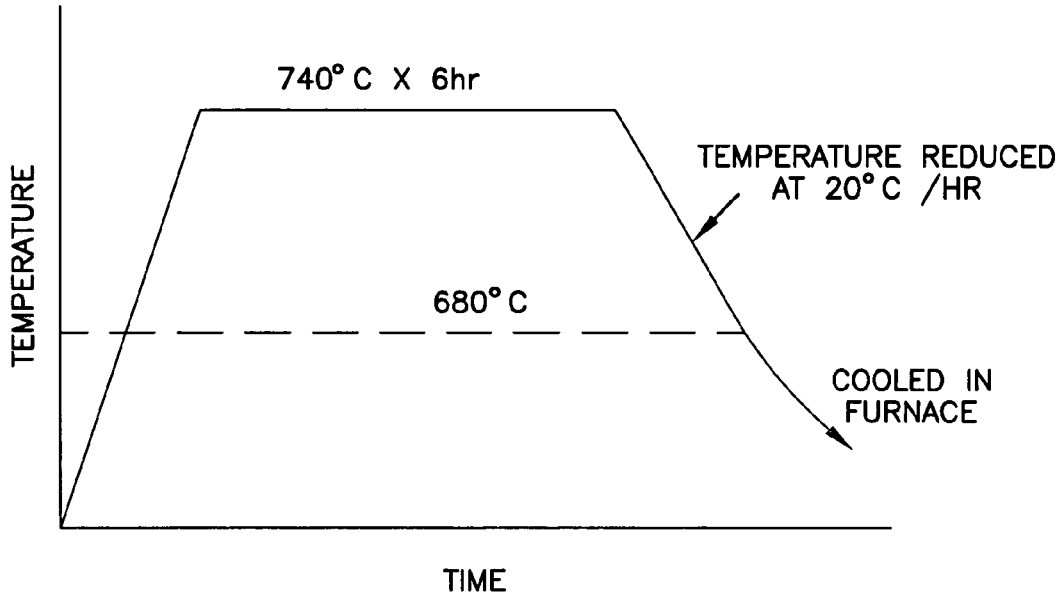
FIGS. 11(*a*) and 11(*b*) are graphs showing annealing patterns 1, 2, respectively.
Figure 11B:
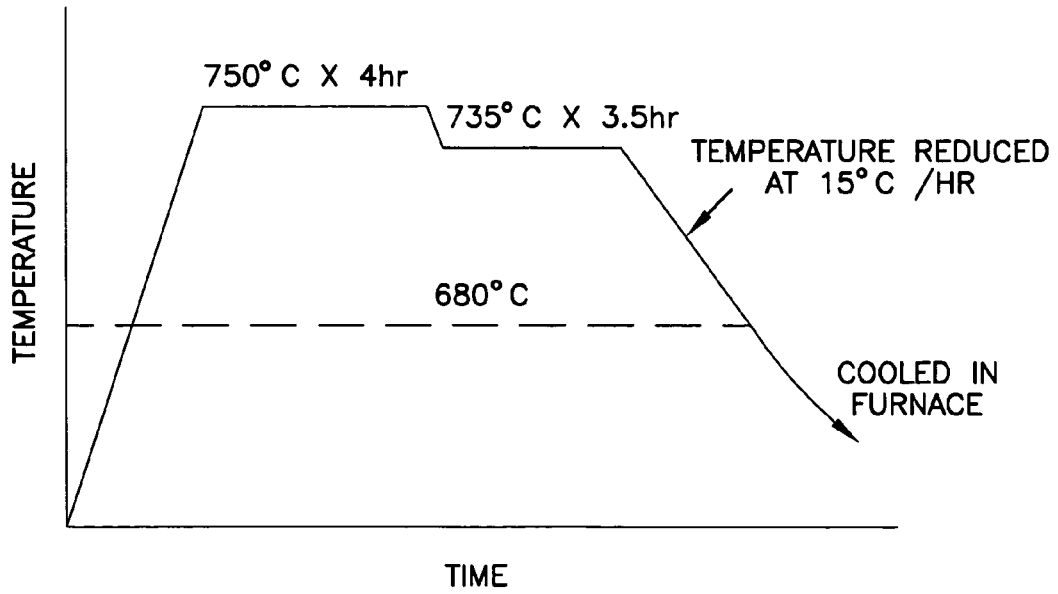

The billet 7 or the coil material 8 is of the above constituents, and the annealing conditions are shown in FIG. 11(*a*). Specifically, the billet 7 or the coil material 8 was held at 740° C. for 6 hours, and thereafter the temperature was dropped to about 680° C. at a rate of 20° C./h, after which the billet 7 was cooled in the furnace according to a pattern 1 shown in FIG. 11(*a*), and the billet 7 or the coil material 8 was held at about 750° C. for 4 hours, held at about 735° C. for 3.5 hours, and thereafter the temperature was dropped to about 680° C. at a rate of 15° C./h, after which the billet 7 was cooled in the furnace according to a pattern 2 shown in FIG. 11(*b*).

Actual metal structures will be described below with reference to microscopic photographic presentations of the metal structures.

Figure 12A:
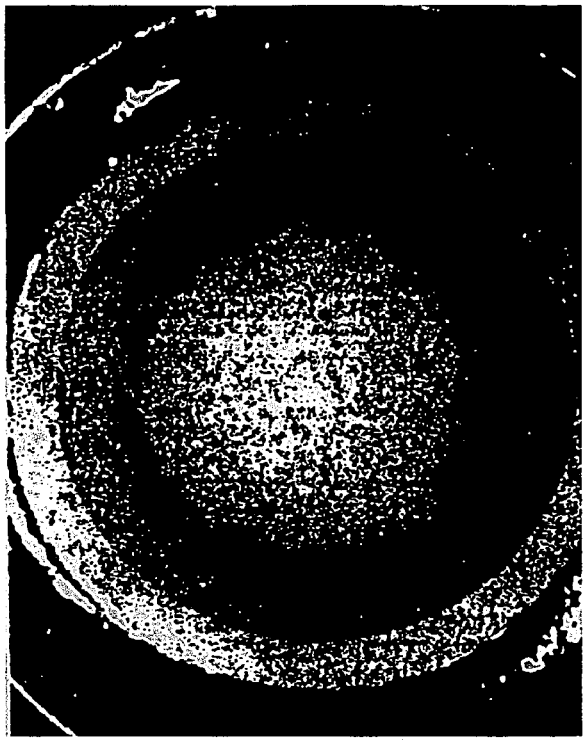
FIG. 12(*a*) is a photographic representation of a cross section of a billet whose surface has been turned into a martensitic structure.
Figure 12B:
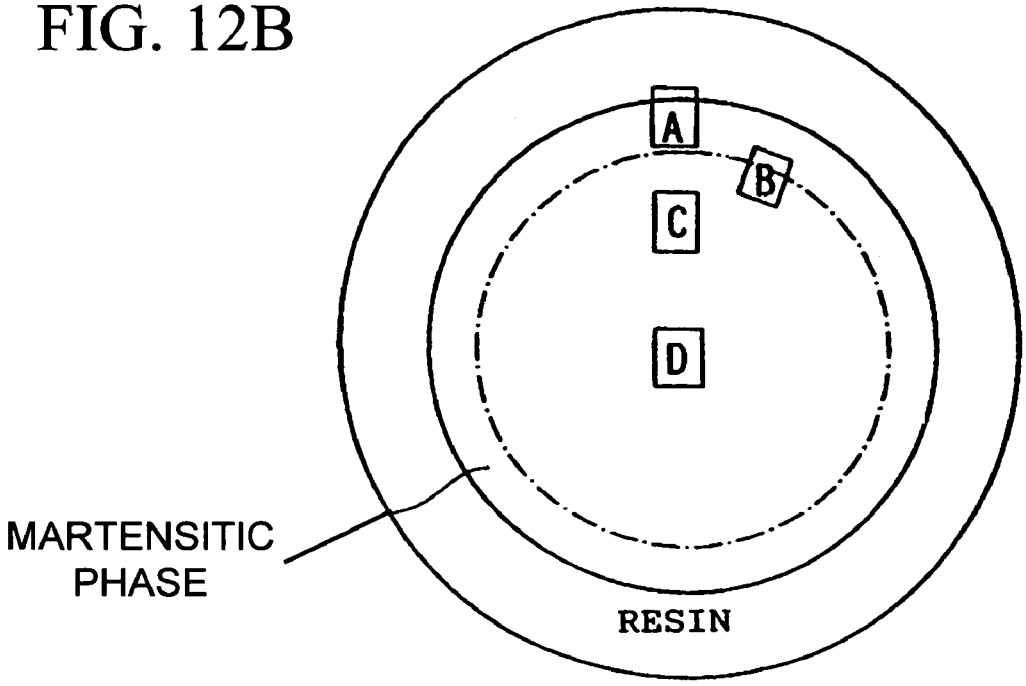
Figure 13:
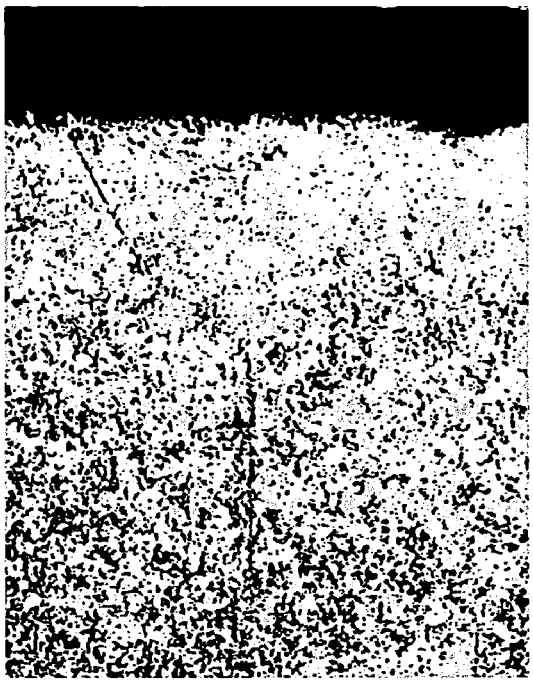
FIG. 13 is a microscopic photographic presentation showing the metal structure of a portion A shown in FIG. 12(*b*) at a magnification of 100.
Figure 14:
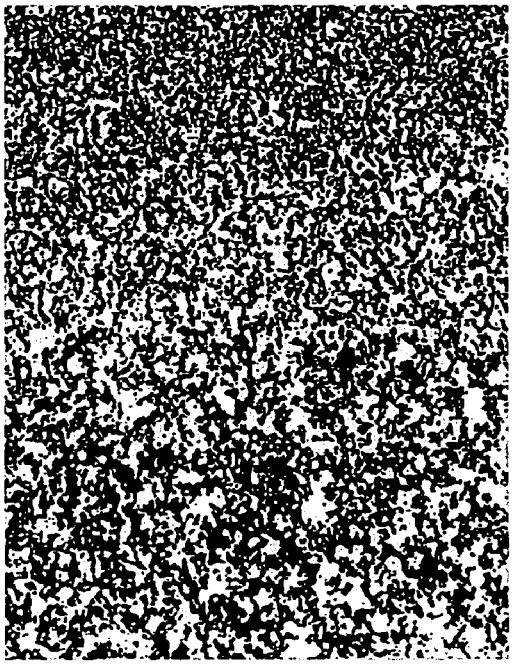
FIG. 14 is a microscopic photographic presentation showing the metal structure of a portion B shown in FIG. 12(*b*) at a magnification of 200.
Figure 15:
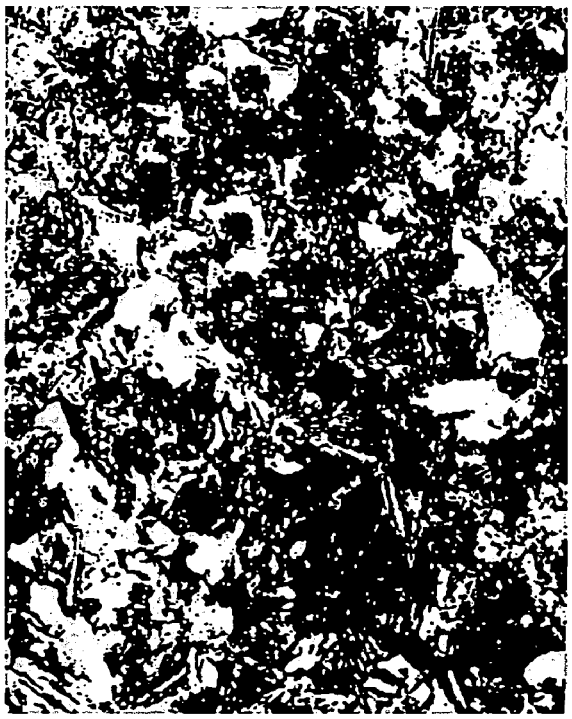
FIG. 15 is a microscopic photographic presentation showing the metal structure of a portion C shown in FIG. 12(*b*) at a magnification of 400.
Figure 16:
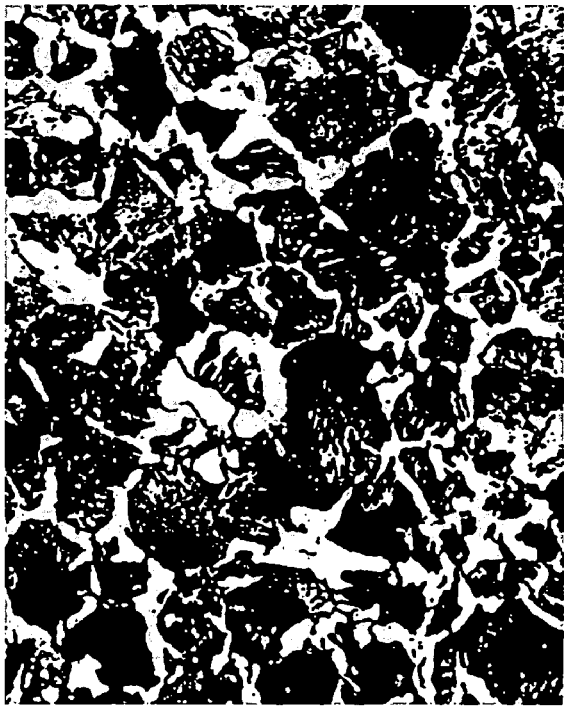
FIG. 16 is a microscopic photographic presentation showing the metal structure of a portion D shown in FIG. 12(*b*) at a magnification of 400.

FIGS. 12 through 16 are microscopic photographic presentations showing metal structures before being annealed. FIG. 12(*a*) is a photographic representation of a cross section of a billet whose surface has been turned into a martensitic structure, and FIG. 12(*b*) is a diagram produced based on the photographic representation of FIG. 12(*a*), including different portions whose metal structures are shown in FIGS. 13 through 16. FIG. 13 is a microscopic photographic presentation showing the metal structure of a portion A shown in FIG. 12(*b*) at a magnification of 100, FIG. 14 is a microscopic photographic presentation showing the metal structure of a portion B shown in FIG. 12(*b*) at a magnification of 200, FIG. 15 is a microscopic photographic presentation showing the metal structure of a portion C shown in FIG. 12(*b*) at a magnification of 400, and FIG. 16 is a microscopic photographic presentation showing the metal structure of a portion D shown in FIG. 12(*b*) at a magnification of 400. In FIG. 12(*a*), disposed outside of the billet is a holder of resin.

Of the above microscopic photographic presentations, FIGS. 13 and 14 indicate that a fine martensitic phase is formed in the surface layer, and an intermediate layer is formed radially inwardly of the martensitic phase, FIG. 15 indicates that the intermediate layer comprises a mixed phase of martensite, ferrite, and pearlite, and FIG. 16 indicates that the central region comprises a mixed phase of ferrite and pearlite with no martensite.

FIGS. 17 through 24 are microscopic photographic presentations of the metal structures of the billet which has been pickled in an acid and spheroidized by annealing in the patterns 1, 2.

Figure 17A:
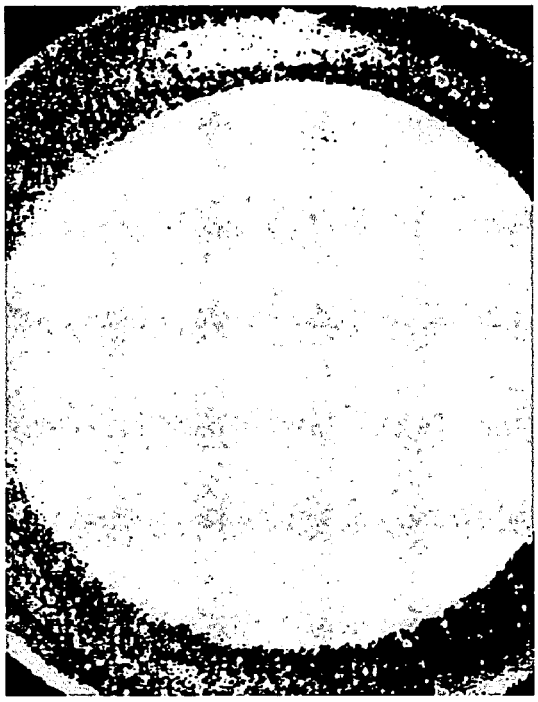
FIG. 17(*a*) is a photographic representation of a cross section of a billet whose martensitic structure has been spheroidized by annealing in the pattern 1.
Figure 17B:
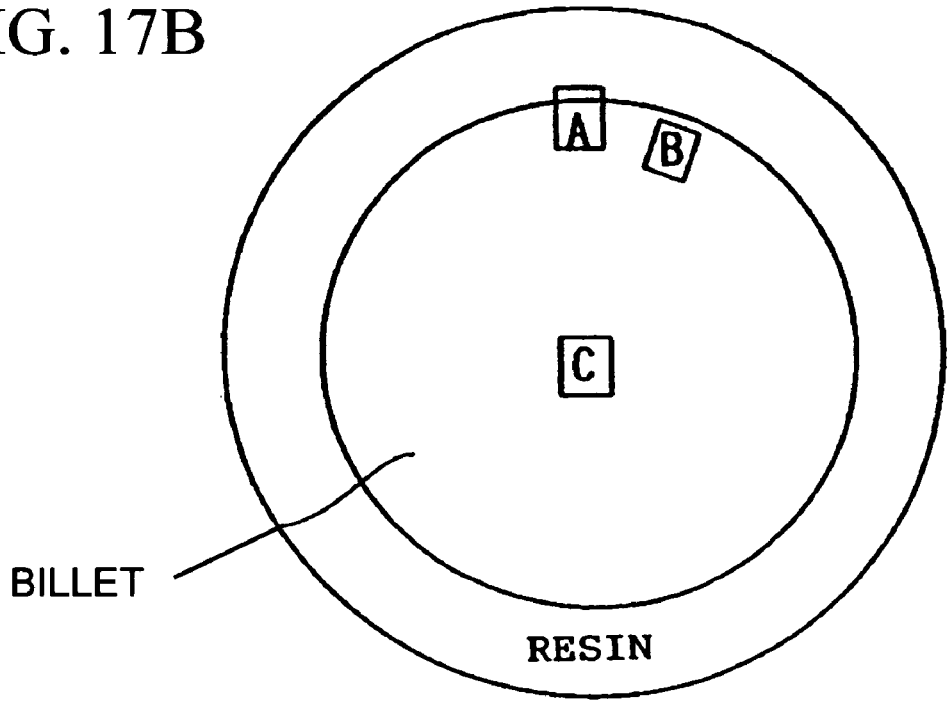
Figure 18:
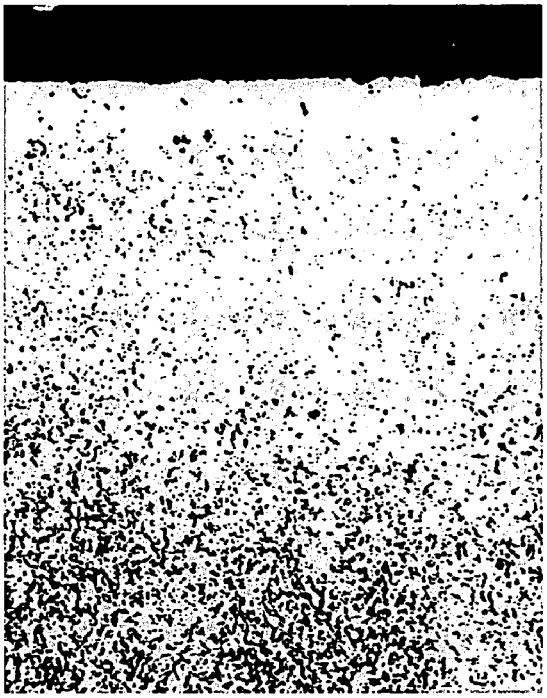
FIG. 18 is a microscopic photographic presentation showing the metal structure of a portion A shown in FIG. 17(*b*) at a magnification of 100.
Figure 19:
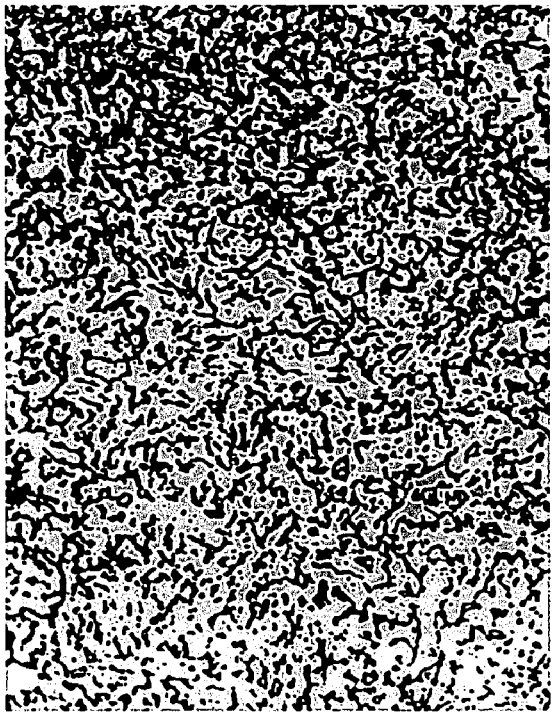
FIG. 19 is a microscopic photographic presentation showing the metal structure of a portion B shown in FIG. 17(*b*) at a magnification of 400.
Figure 20:
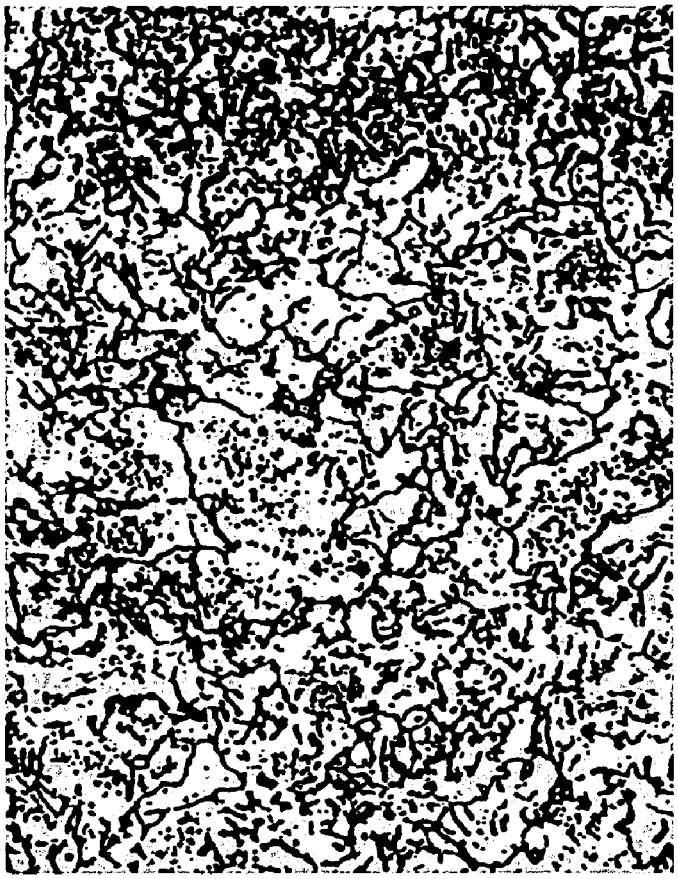
FIG. 20 is a microscopic photographic presentation showing the metal structure of a portion C shown in FIG. 17(*b*) at a magnification of 400.
Figure 21A:
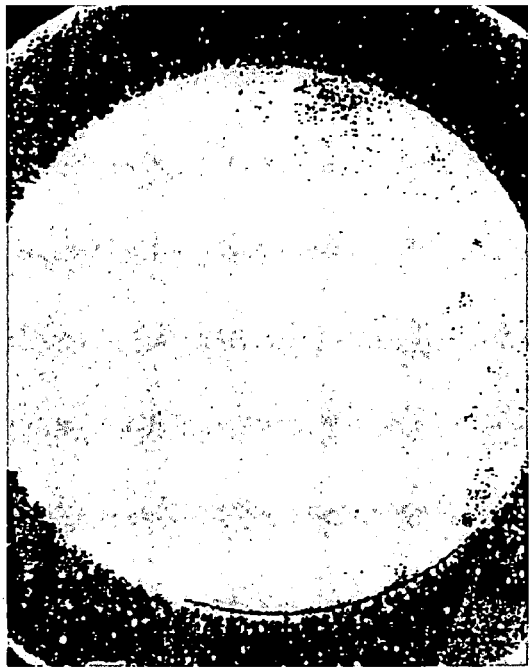
FIG. 21(*a*) is a photographic representation of a cross section of a billet whose martensitic structure has been spheroidized by annealing in the pattern 2.
Figure 21B:
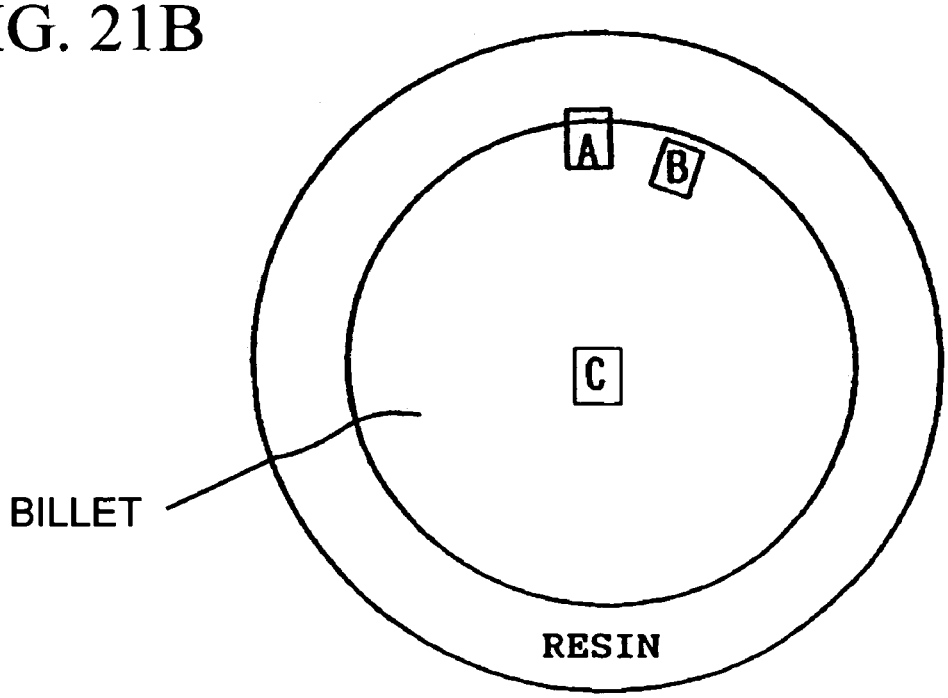
Figure 22:
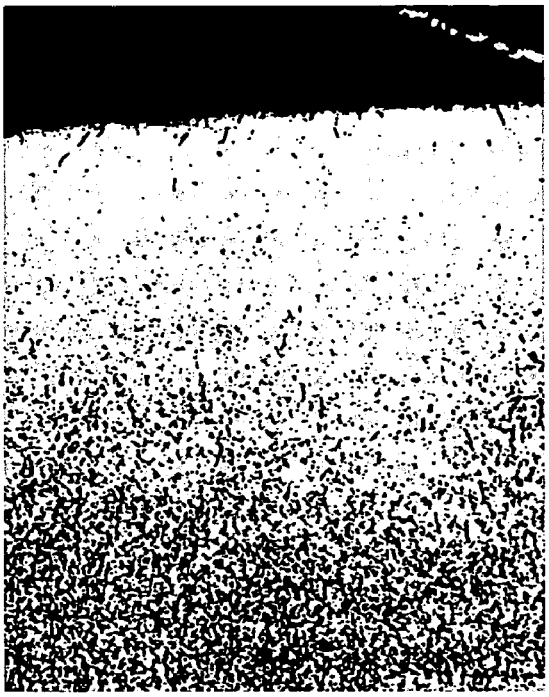
FIG. 22 is a microscopic photographic presentation showing the metal structure of a portion A shown in FIG. 21(*b*) at a magnification of 100.
Figure 23:
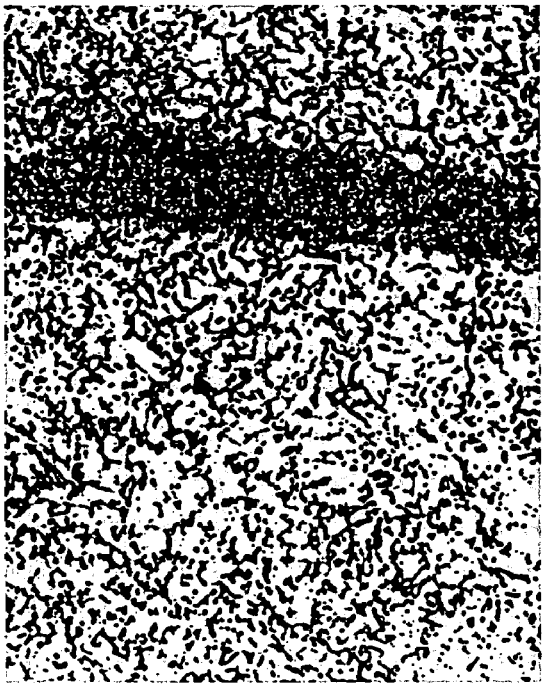
FIG. 23 is a microscopic photographic presentation showing the metal structure of a portion B shown in FIG. 21(*b*) at a magnification of 400.
Figure 24:
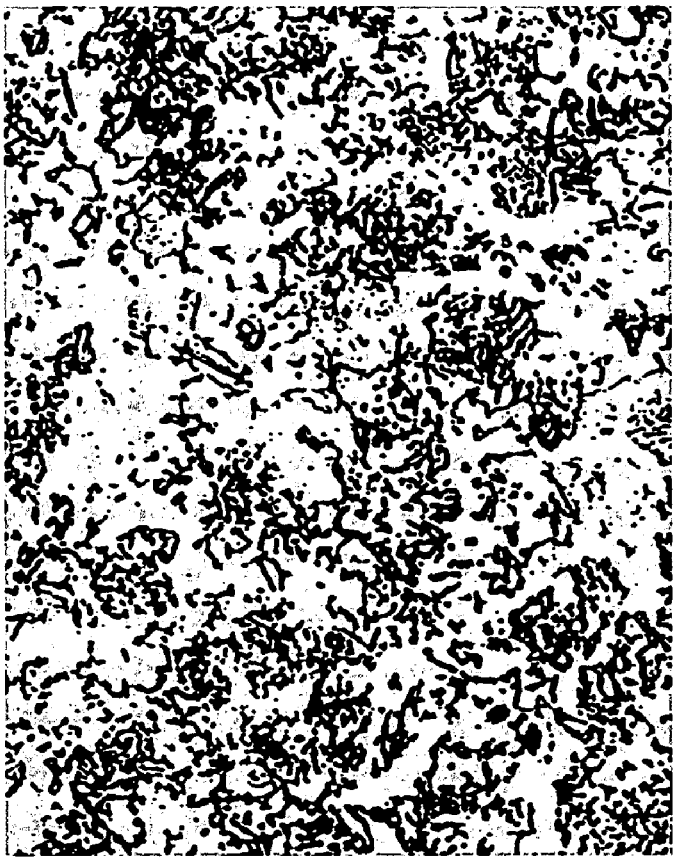
FIG. 24 is a microscopic photographic presentation showing the metal structure of a portion C shown in FIG. 21(*b*) at a magnification of 400.
Figure 25:
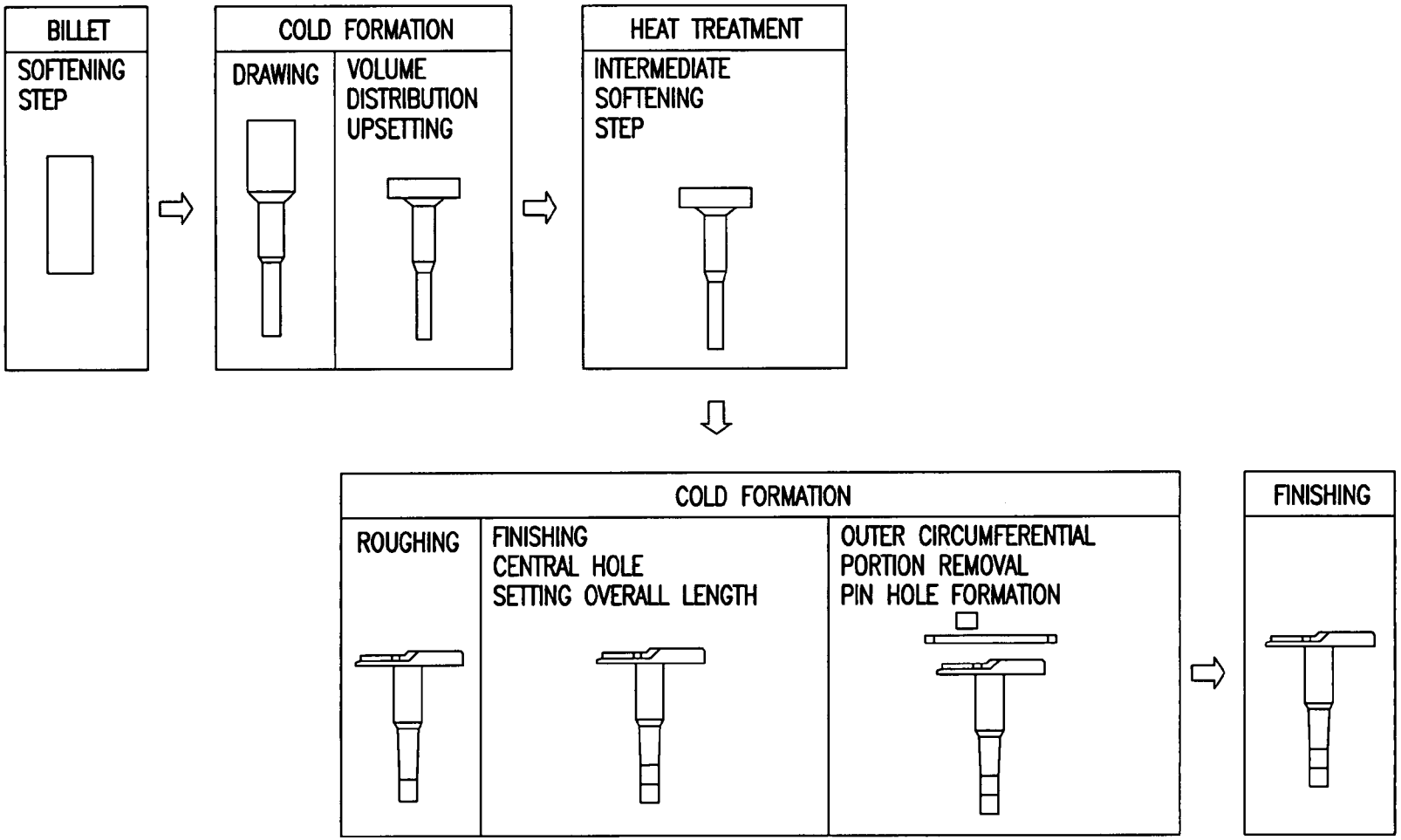
FIG. 25 is a diagram illustrative of a conventional cold-forging process for manufacturing a crankshaft.

FIG. 17(*a*) is a photographic representation of a cross section of a billet whose martensitic structure has been spheroidized by annealing in the pattern 1, FIG. 17(*b*) is a diagram produced based on the photographic representation of FIG. 17(*a*), including different portions whose metal structures are shown in FIGS. 18 through 20, FIG. 18 is a microscopic photographic presentation showing the metal structure of a portion A shown in FIG. 17(*b*) at a magnification of 100, FIG. 19 is a microscopic photographic presentation showing the metal structure of a portion B shown in FIG. 17(*b*) at a magnification of 400, FIG. 20 is a microscopic photographic presentation showing the metal structure of a portion C shown in FIG. 17(*b*) at a magnification of 400, FIG. 21(*a*) is a photographic representation of a cross section of a billet whose martensitic structure has been spheroidized by annealing in the pattern 2, FIG. 21(*b*) is a diagram produced based on the photographic representation of FIG. 21(*a*), including different portions whose metal structures are shown in FIGS. 22 through 24, FIG. 22 is a microscopic photographic presentation showing the metal structure of a portion A shown in FIG. 21(*b*) at a magnification of 100, FIG. 23 is a microscopic photographic presentation showing the metal structure of a portion B shown in FIG. 21(*b*) at a magnification of 400, and FIG. 24 is a microscopic photographic presentation showing the metal structure of a portion C shown in FIG. 21(*b*) at a magnification of 400.

It can be understood from these figures that the metal structures do not differ from each other irrespective of the annealing patterns shown in FIGS. 11(*a*) and 11(*b*), and the martensitic phase in the surface layer is of a fine spheroidized structure comprising a mixed phase of ferrite and cementite. In the central region, of a mixed phase of ferrite and pearlite, pearlite is in the process of being broken and spheroidized, with slightly needle-shaped carbide being present.

Table 2 shown below indicates the results of an upsetting test and a crankshaft forming test on different materials and spheroidizing processes.

The upsetting test was conducted on a billet whose size was represented by a diameter of 34.67 and a length of 60 at a compression ratio of 87.5%, and the crankshaft forming test was conducted on a billet whose size was represented by a diameter of 34.67 and a length of 73 partly at an upsetting ratio of 93% and a drawing ratio of 93%. In the results of a cracking confirmation test, the denominator represents the number of test pieces subjected to the test, and the numerator the number of test pieces which cracked.

Table 2

It has been confirmed from Table 2 that the billet processed by the method according to the third invention did not crack as with the billet which was subjected to spheroidizing annealing before and after being drawn.

In Table 2, the R material is a material that is air-cooled by the cooling bed, rather than being quenched, and the controlled rolling material is of a fine alpha structure produced by strictly controlling hot rolling conditions. Since the R material, even if annealed, tends to crack upon being forged, it has heretofore been customary to use the controlled rolling material. However, it can be seen that the controlled rolling material is caused to crack if it has been annealed once. It can also be seen that no cracking occurs if the material is annealed before and after being drawn, and the surface-hardened steel according to the present invention is not caused to crack even if it has been annealed once.

According to the third invention, as described above, the surface of the blank unloaded from the heating furnace is turned into a fine martensitic structure by quenching the blank after it has been rolled, and then the blank is annealed to change the martensite into a fine spheroidized structure comprising ferrite and cementite. Therefore, it is possible to produce a billet which is of low hardness and excellent deformability in its both surface and inside.

By cold-forging the billet which is of low hardness and excellent deformability, it can continuously be cold-forged until the end of the process without the need for an intermediate softening step. Therefore, the cost of the equipment can greatly be reduced, and the working environment can be improved.

If an engine part with a shaft, such as a crankshaft or the like, is manufactured from the billet according to the third invention, it is not necessary to make a plurality of preparatory actions as with the conventional hot forging process, and a subsequent grinding process can be dispensed with.

Fourth and fifth inventions relate to a method of forging a disk-shaped part with a shaft such as a split-type crankshaft for a motorcycle engine or the like. The method allows a disk-shaped part with a shaft to be continuously cold-forged, rather than being hot forged as has been conventional, so that mechanical machining and surface finishing in subsequent steps for padding removal are dispensed with. The fourth and fifth inventions will be described below with reference to FIGS. 27 through 34.

Figure 27:
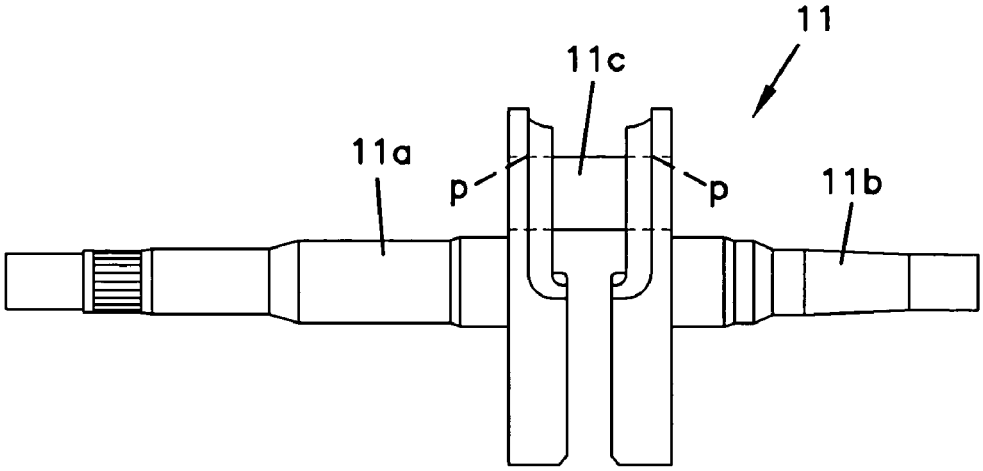
FIG. 27 is a view showing an assembled crankshaft for use in a motorcycle.
Figure 28:
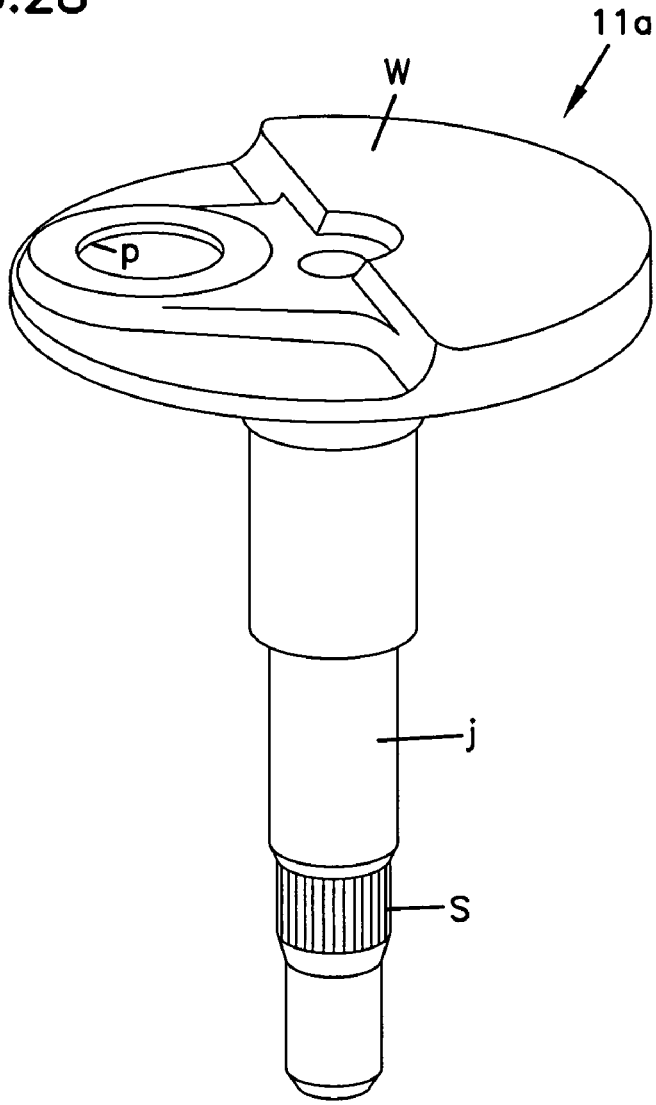
FIG. 28 is a perspective view of a left crankshaft member of the crankshaft.

FIG. 27 is a view showing an assembled crank shaft for use in a motorcycle, FIG. 28 is a perspective view of a left crankshaft member of the crankshaft, and FIGS. 29 through 33 are views illustrative of a method of cold-forging a crankshaft according to the fourth and fifth inventions.

The method is applied to the manufacture of a crankshaft 11*a*, as a disk-shaped part with a shaft, on one side (left side in the embodiment) of a crankshaft 11 shown in FIG. 27.

Specifically, the crankshaft 11 comprises left and right split-type crankshafts 11*a*, 11*b*, each as a disk-shaped part with a shaft, and a coupling pin 11*c* joined in pin holes p defined in counterweights of the crankshafts 11*a*, 11*b*. The cold-forging method according to the invention is applicable to either one of the crankshafts 11*a*, 11*b*. For illustrative purpose, the left crankshaft 11*a* with splines formed on its shaft will be described below as a representative example.

As shown in FIG. 28, the left crankshaft 11*a* has a counterweight w having asymmetrical thicknesses with complex surface irregularities on an outer surface thereof, and a multi-stepped shaft j having at least two different-diameter portions. Splines s are formed on a portion of the multi-stepped shaft j. The crankshaft 11*a* is continuously cold-forged from a cylindrical billet B shown in a left portion of FIG. 29. The compositional constituents of the billet B and a method of manufacturing the billet B will briefly be described below.

The billet B is made of a steel (hereinafter referred to as S48C) which is composed of 0.46–0.48 wt % of C (carbon), 0.14 or less of Si (silicon), 0.55–0.65 wt % of Mn (manganese), 0.015 wt % or less of P (phosphorus), 0.015 wt % or less of S (sulfur), 0.15 wt % or less of Cu (copper), 0.20 wt % or less of Ni (nickel), and 0.35 wt % or less of Cr (chromium).

The billet B is manufactured from a bar of the steel having the above compositional constituents according to the method of the second invention or the third invention as described above.

Figure 29A:
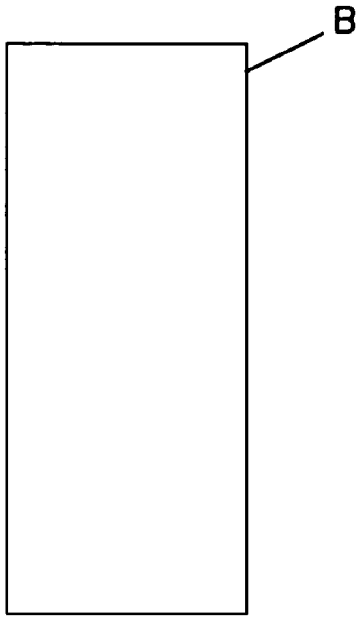
FIG. 29(*a*) is a view of a billet to be processed in a first step of methods of cold-forging a crankshaft according to fourth and fifth inventions.
Figure 29B:
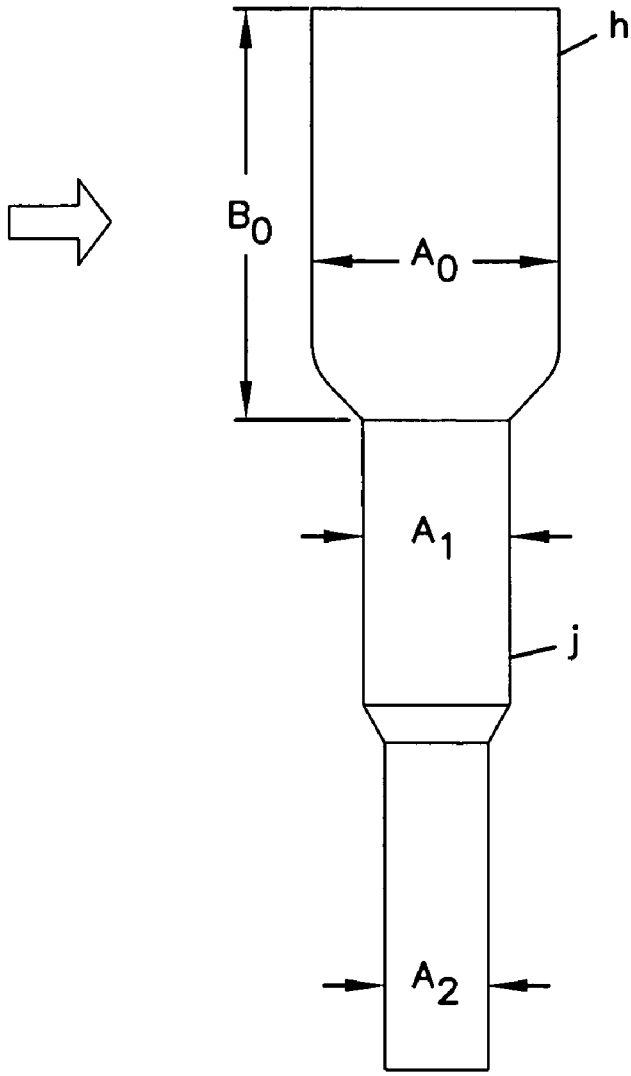

The crankshaft 11*a* is cold-forged as follows: As shown in FIG. 29, the billet B prepared according to the above manufacturing method is pressed downwardly to draw, in a restrained fashion, a multi-stepped shaft j having different-diameter portions which is contiguous to a main body h that is of substantially the same diameter as the billet B, in a first step.

In the embodiment, the multi-stepped shaft j has two portions, i.e., a medium-diameter portion having a cross-sectional area A1 and a small-diameter portion having a cross-sectional area A2. If the cross-sectional area of the main body h, which is substantially the same as the original cross-sectional area of the billet B, is A0, then the small-diameter portion is drawn at a drawing ratio of about (A0−A2)/A0×100=75–85%, so that no buckling or breakage will be caused in a subsequent up setting step for reducing the diameter of a portion of the free end of the multi-stepped shaft j.

Figure 30A:
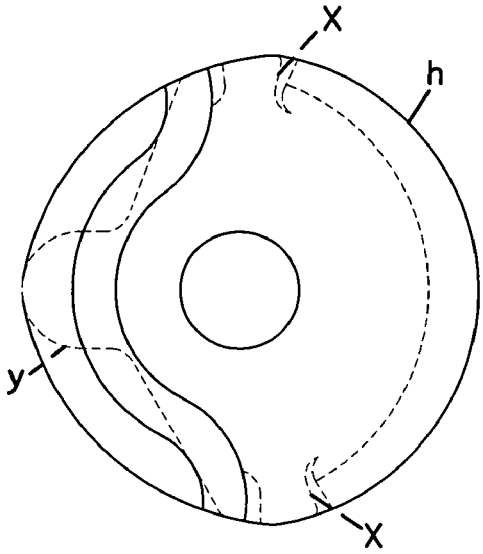
FIGS. 30(*a*), 30(*b*), and 30(*c*) are plan, front elevational, and side elevational views, respectively, of a workpiece processed by a second step of the methods of cold-forging a crankshaft according to the fourth and fifth inventions.
Figure 30B:
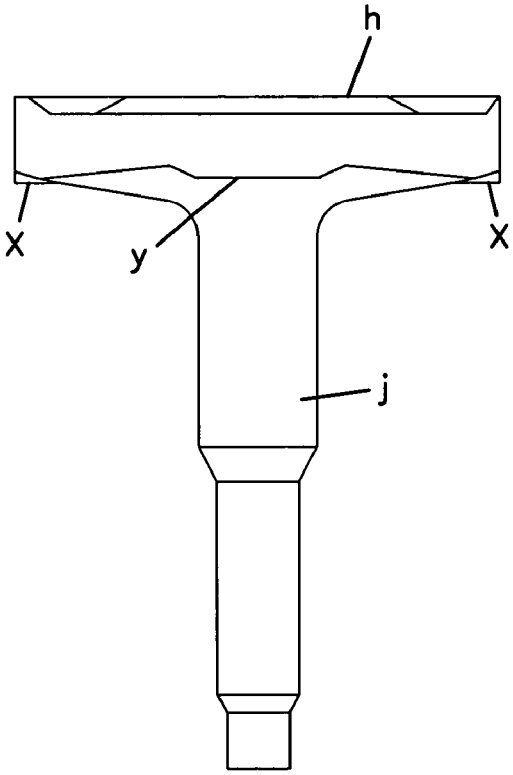
Figure 30C:
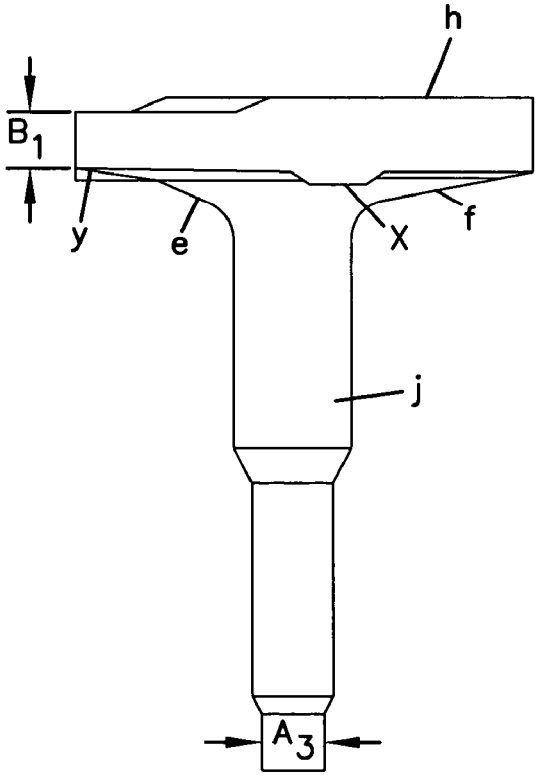

In a second step, as shown in FIG. 30, the diameter of the main body h is increased and the diameter of the free end of the multi-stepped shaft j is reduced by upsetting and drawing.

Since the main body h will finally have to be finished into asymmetrical volumes (e.g., 1:2) with different thicknesses on left and right sides, the main body h is upset to slightly different thicknesses depending on the distribution of the volumes at this stage, with lower surfaces inclined at different angles to the direction in which the thickness varies, as shown in FIG. 30, such that the angle of inclination of a lower surface e of the thinner portion is greater than the angle of inclination of a lower surface f of the thicker portion.

The angles of inclination are used to adjust the flow of the material in the subsequent upsetting step for thereby preventing the material from flowing toward the thinner portion and allowing the material to flow easily toward the thicker portion.

In the embodiment, as shown in FIG. 30(*a*), the smaller angle of inclination of the lower surface f remains substantially the same, e.g., about 10 to 12 degrees, in a range wherein a junction line (indicated by the broken line) between the inclined surface and the flat surface is spaced substantially the same distance from the center of the multi-stepped shaft j over a substantially half on the right portion, and the greater angle of inclination of the left lower surface e is progressively greater from the opposite sides toward the center, the angle being maximum in the range from about 20 to 23 at the center.

An excessive portion y is disposed outside of the inclined surface e having the greater angle of inclination, and other excessive portions x are disposed on opposite lower surfaces that are 90° out of phase with the excessive portion y.

These excessive portions y, x serve to prevent an underfill from being formed in the step at an asymmetrical boundary in a subsequent step, and may be disposed on upper surfaces, rather than the lower surfaces.

If the main body h has a height B0 after the first step shown in FIG. 29 and the thinner portion of the main body h has a thickness B0 after the second step shown in FIG. 30, then the thicknesses are selected such that (B0−B1)/B0×100=75–85%, and if the free end of the multi-stepped shaft j after the second step has a cross-sectional area A3, then the cross-sectional area is selected such that (A0−A3)/Aa0×100=82–88%.

Figure 31A:
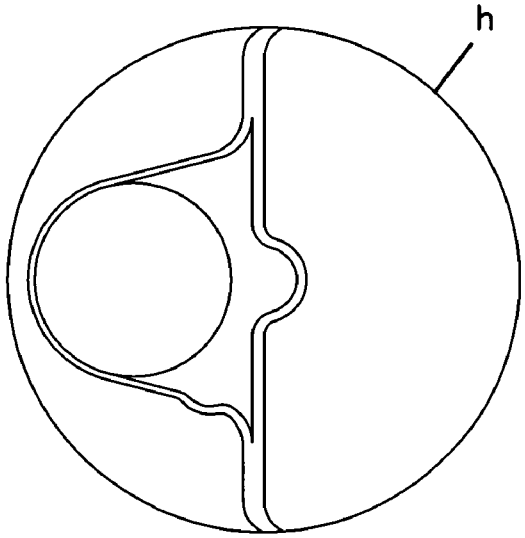
FIGS. 31(*a*) and 31(*b*) are front and side elevational views, respectively, of a workpiece processed by a third step of the methods of cold-forging a crankshaft according to the fourth and fifth embodiments of the present invention.
Figure 31B:
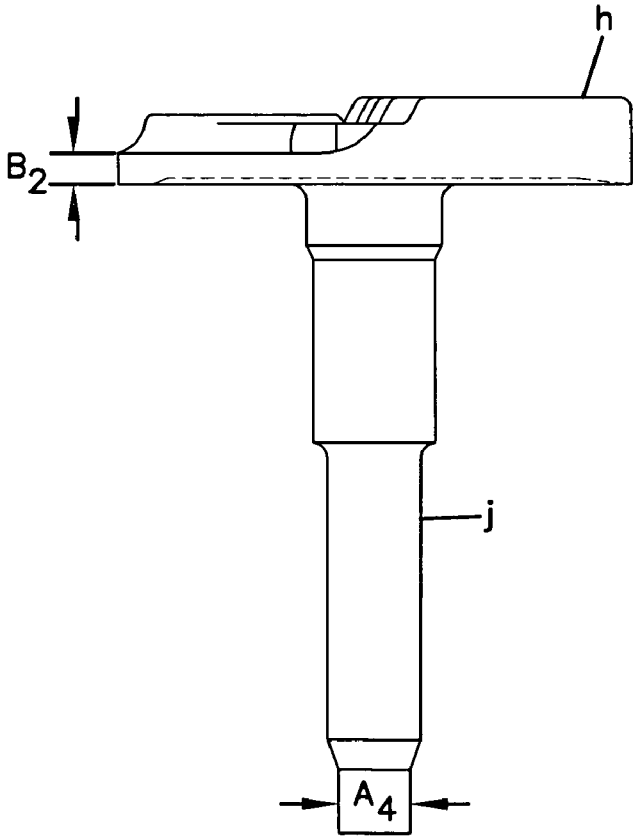

In a third step, as shown in FIG. 31, the main body h is upset to rough the same so as to make it shaped closely to the shape of the counterweight w shown in FIG. 28, the corner of the step of the multi-stepped shaft j is sharpened, and the diameter of the free end is reduced.

Since the upset main body h has been formed by a lower die having different angles of inclination as described above with respect to the second step, the volume of the thicker portion and the volume of the thinner portion have a ratio of about ⅔:⅓.

Figure 35:
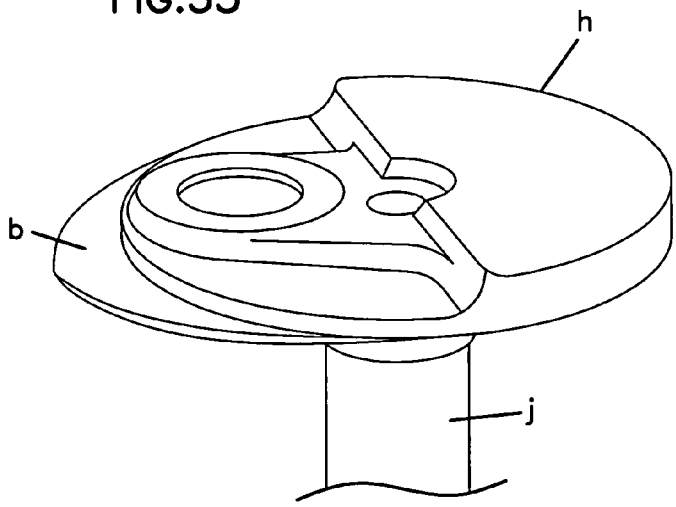
FIG. 35 is a fragmentary perspective view illustrative of a large burr produced due to an insufficient volume distribution.

Assuming that the ratio of the volume of the thicker portion and the volume of the thinner portion is to be set to about ⅔:⅓ without different angles of inclination on the lower surface, if the main body h has a volume V, as shown in FIG. 35, a burr b having a volume of ½ V−⅓ V=⅙ V is formed, resulting in an increased pressurizing area which requires an excessive load tending to damage the dies and also to cause the thinner position to crack and suffer poor accuracy.

The volume difference may be formed upon forging by a general process of initially holding the main body h and the multi-stepped shaft j out of coaxial alignment with each other, producing an eccentric shaft, and thereafter applying a compressive load on the shaft. According to this process, however, if the volume difference is to be of a large value of about ½:⅓, then the material is liable to crack. Therefore, the process cannot be employed.

With the different angles of inclination being provided on the lower surface, as described above, to adjust the material flow upon forging for achieving the volume difference, the material is not subject to cracking, and the main body can be forged without the application of an excessive load.

If the thinner portion of the main body h after the third step has a thickness B2, then the thickness is selected such that (B0−B2)/B0×100=90–92%, and if the free end of the multi-stepped shaft j after the third step has a cross-sectional area A4, then the cross-sectional area is selected such that (A0−A4)/A0×100=88–92%.

Figure 32A:
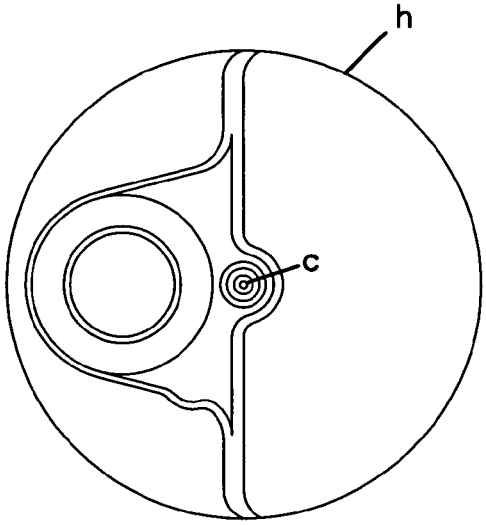
FIGS. 32(*a*) and 32(*b*) are front and side elevational views, respectively, of a workpiece processed by a fourth step of the methods of cold-forging a crankshaft according to the fourth and fifth inventions.
Figure 32B:
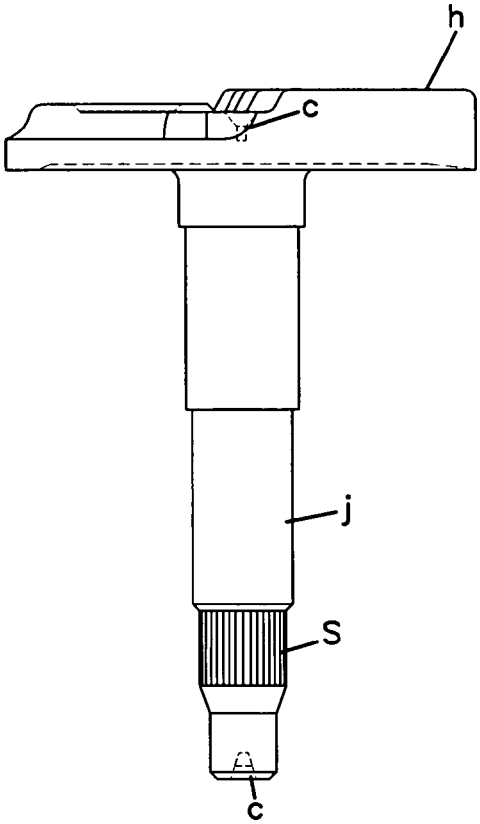

In a fourth step, as shown in FIG. 32, the asymmetrical boundary of the main body h is pressurized to reduce the roundness of the step for thereby finishing the main body h to the shape of the counterweight w. A central hole c is formed in the center of the surface of the main body h and the center of the free end of the multi-stepped shaft j, and at the same time, splines s are formed on a portion of the multi-stepped shaft j.

Figure 33A:
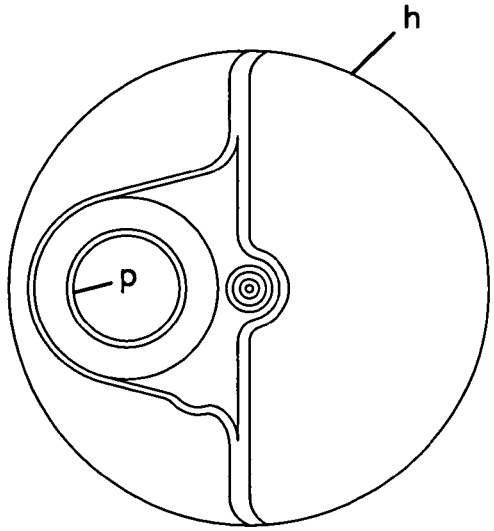
FIGS. 33(*a*) and 33(*b*) are front and side elevational views, respectively, of a workpiece processed by a fifth step of the methods of cold-forging a crankshaft according to the fourth and fifth inventions.
Figure 33B:
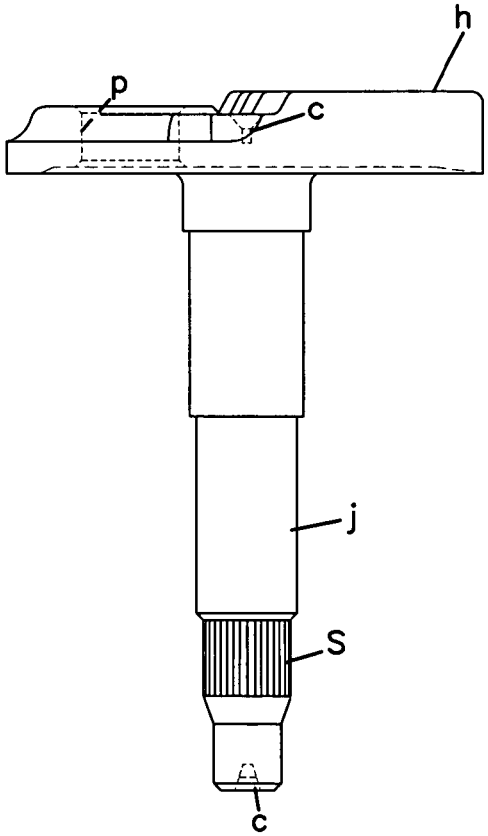

In a final fifth step, as shown in FIG. 33, a pin hole p is punched through the main body h, and at the same time a burr or the like (not shown) is removed from the outer peripheral edge of the main body h.

When the pin hole p is punched, the corners of the peripheral edge of the pin hole p on the upper and lower surfaces are beveled.

The crankshaft 11*a* of the shape shown in FIG. 28 is formed according to the method described above. The other crankshaft 11*b* shown in FIG. 27 is formed in substantially the same manner as described above. The crankshafts 11*a*, 11*b* are integrally joined to each other by the coupling pin 11*c* fitted in the pin holes p in the crankshafts 11*a*, 11*b*.

The above series of the cold-forging steps can continuously be performed without the need for an intermediate annealing step if the time intervals between the steps are about 6 minutes or less because a large amount of carbide that tends to start cracking is present in the form of a solid solution in ferrite and the elongation ratio increases due to heating upon forging.

Figure 34A:
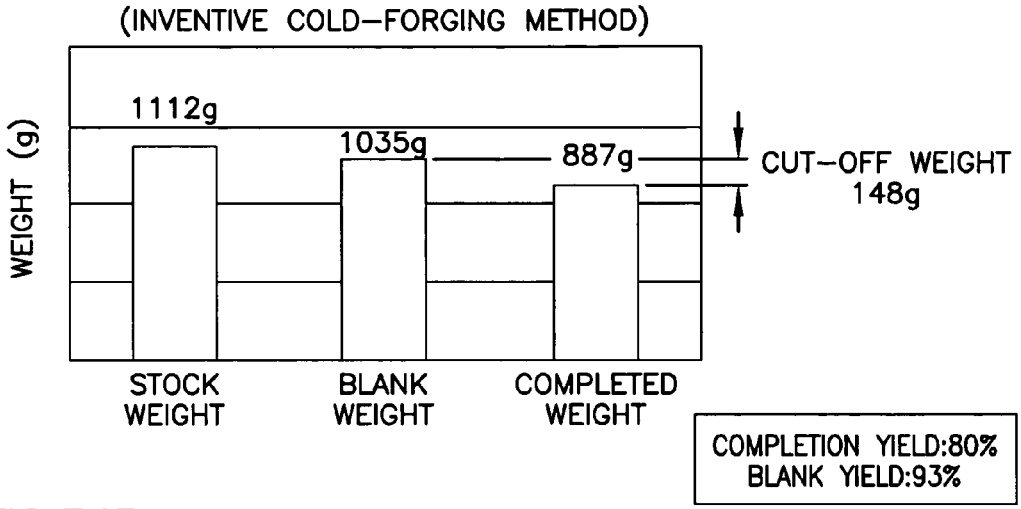
FIGS. 34(*a*) and 34(*b*) are diagrams illustrative of yields of a cold-forging method according to the present invention and a conventional hot-forging method.
Figure 34B:
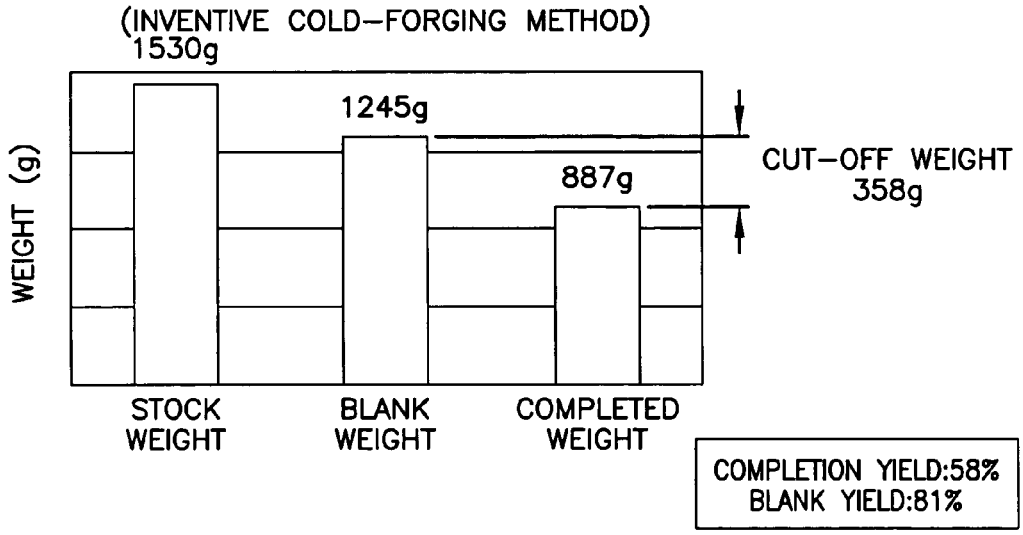

The yields of the crankshaft 11*a* thus manufactured by the above continuous cold-forging method and the crankshaft manufactured by the conventional hot-forging method are compared as shown in FIG. 34.

According to the hot-forging method, as shown in FIG. 34(*b*), in order to manufacture a crankshaft having a completed weight 887 g, a stock weight of 1530 g and a blank weight of 1245 g are necessary, and a weight of 358 g is cut off the blank weight, with a completion yield of 58% and a blank yield of 81%. According to the continuous cold-forging method of the present invention, as shown in FIG. 34(*a*), in order to manufacture a crankshaft having a completed weight 887 g, a stock weight of 1120 g and a blank weight of 1035 g are sufficient, and a weight of 148 g is cut off the blank weight, with a completion yield of 80% and a blank yield of 98%.

In the method of cold-forging a crankshaft according to the fourth invention, the crankshaft is continuously cold-forged from the first step through the fifth step. The yield is increased because scale removal and mechanical machining for achieving accuracy in subsequent steps are dispensed with.

In the fourth step, splines may be formed simultaneously on the end of the multi-stepped shaft, so that mechanical machining for forming splines may also be dispensed with.

In the cold-forging method according to the fifth invention, a disk-shaped part with a shaft, which has a disk that is asymmetrical with respect to the central axis and has different left and right volumes, is formed in a plurality of forging steps. Therefore, the manufacturing process is simplified, and a greater yield than with the cold-forging process can be achieved.

The volume ratio of the disk which is set to about 1:2 is preferable for a counterweight for a crankshaft, for example.

For a volume distribution, inclined surfaces having different angles of inclination are formed on left and right joints from the blank shaft to the disk in the forging process, and the angle of inclination of the greater-volume portion is smaller than the angle of inclination of the smaller-volume portion. With this arrangement, the crankshaft can be formed without cracking in the material, and the forging load can be reduced.

A method of cold-forging a crankshaft according to a sixth invention is characterized by using the billet having the above compositional constituents, and will be described below with reference to FIGS. 36 through 39.

A billet from which the crankshaft shown in FIG. 27 is formed is made of a carbon steel which is composed of 0.46–0.48 wt % of C, 0.14 or less of Si, 0.55–0.65 wt % of Mn, 0.015 wt % or less of P, 0.015 wt % or less of S, 0.15 wt % or less of Cu, 0.20 wt % or less of Ni, 0.35 wt % or less of Cr, and a remainder of Fe and impurities.

The billet is manufactured from a bar of the above composition by the method according to the second invention or the third invention.

A billet manufactured according to the above process is prepared. In a first step, the billet is processed into a multi-stepped intermediate blank. In a second step, the multi-stepped intermediate blank is up set to increase the diameter of a large-diameter portion. In a third step, the thickness of the large-diameter portion is roughed into an approximate asymmetrical counter-weight shape. In a fourth step, the large-diameter portion is finished into an asymmetrical shape, and splines and a central hole are formed in required positions, if necessary.

In a fifth step, a pin hole is punched in a portion of the large-diameter portion, and at the same time, a burr is removed from the outer peripheral edge of the large-diameter portion. The above series of cold forging steps is continuously carried out without the need for intermediate annealing.

An aging process according to the sixth invention is performed on the crankshaft thus produced by holding the crankshaft at 250 to 350° C. for 1 to 2.5 hours, and thereafter cooling the crankshaft to normal temperature.

Crankshaft were cold-forged using a carbon steel having the composition shown in Table 3 below, and aged for various heating times shown in Table 4. The crankshafts were measured for surface hardness (HRC) prior to the aging, surface hardness (HRC) subsequent to the aging, and internal hardness (HRC), and analyzed for metal crystal lattice constants by way of X-ray diffraction.

The temperature of the aging process was 300° C., and No. A in Table 4 was not subjected to the aging process.

Table 3

Table 4

The correlations between the hardnesses (HRC) prior and subsequent to the aging process and the average lattice constants were compared with each other. The results are shown in Table 5. It is found that the greater the average lattice constant (d value), the higher the hardness (HRC).

Table 5

This means that as more lattice defects are contained between atoms, i.e., as the average lattice constant (d value) is greater, the hardness is higher. The hardness is increased by the aging process presumably because when the crankshafts are cooled in the atmosphere after it has been heated to a low temperature, precipitations are produced between crystals and many dislocations can be fixed.

Figure 38:
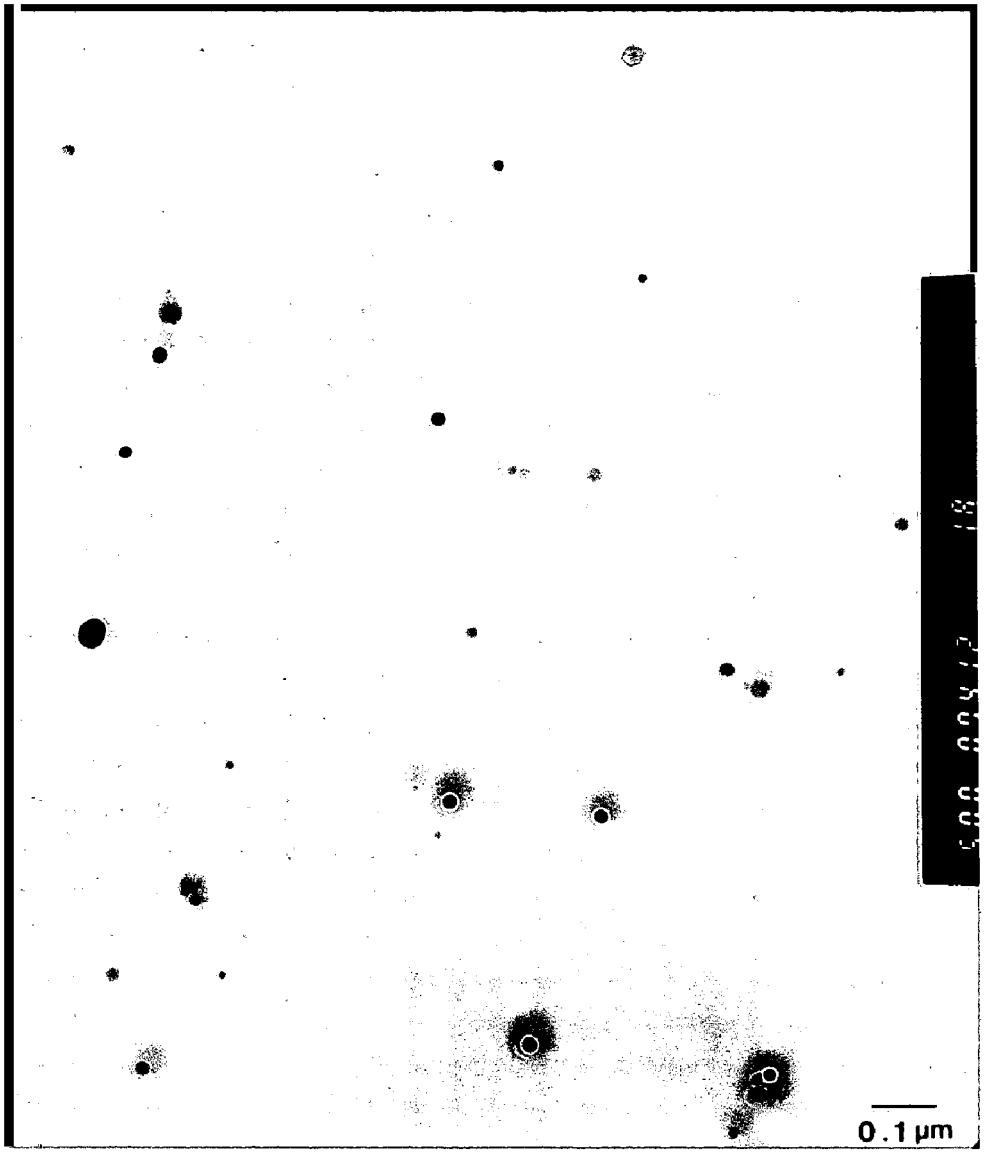
FIG. 38 is a TEM photographic presentation of a metal structure before aging at a magnification of 100,000.
Figure 39:
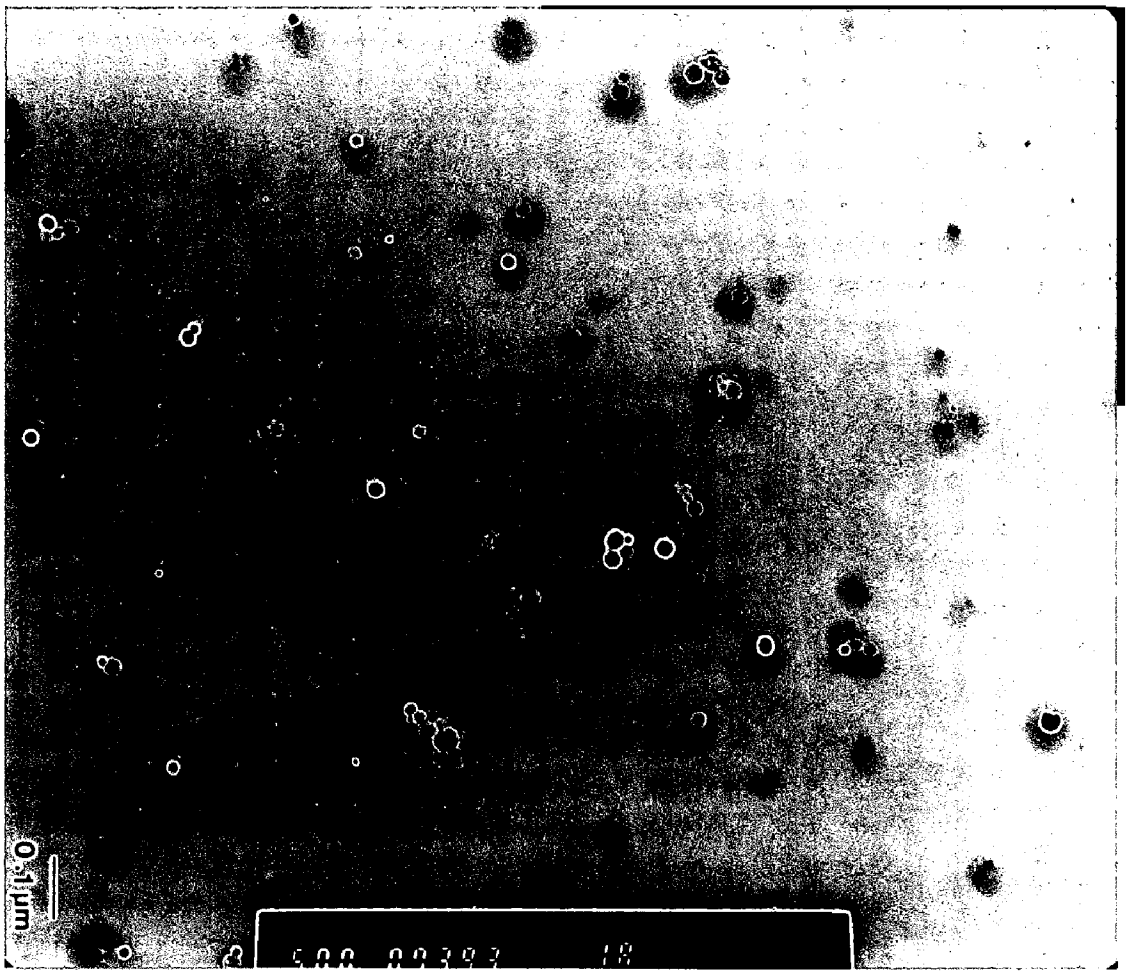
FIG. 39 is a TEM photographic presentation of a metal structure after aging at a magnification of 100,000.

FIG. 38 is a TEM photographic presentation of a metal structure before aging at a magnification of 100,000, and FIG. 39 is a TEM photographic presentation of a metal structure after aging at a magnification of 100,000. It can be confirmed from these photographic presentations that the number of precipitations present between crystals after the aging process is greater than before the aging process. The hardness is considered to be increased by the increased number of precipitations, or the fixation of dislocations, or both.

The increase in the hardness and mechanical strength was maximized by holding the crankshaft at 250 to 350° C. for 1 to 2.5 hours, and thereafter cooling the crankshaft to normal temperature.

The foregoing effect is clearly seen from the analyzed results shown in Table 3–Table 5. In Table 5, the hardness is small in increase at items below No. C (aging time: 1.0 H), reaches its peak between No. D and No. F (aging time: 1.5 to 2.5H), and is reduced due to excessive aging at No. G (aging time: 4 H).

Figure 36A:
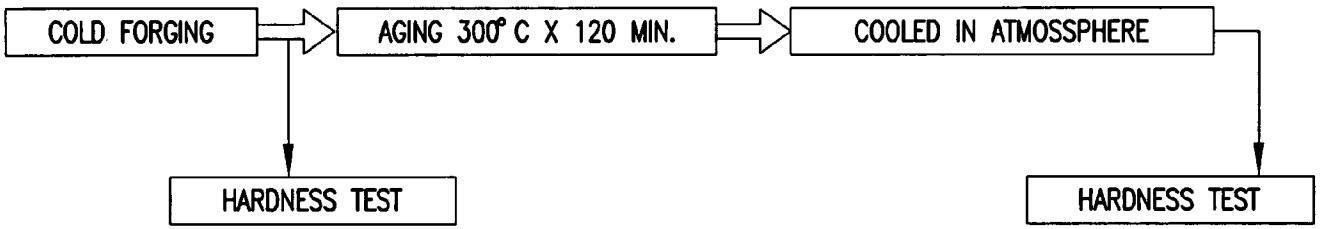
FIGS. 36(*a*), 36(*b*), and 36(*c*) are views showing the timing and measuring points of hardness tests conducted on a crankshaft before and after it is aged.
Figure 36C:
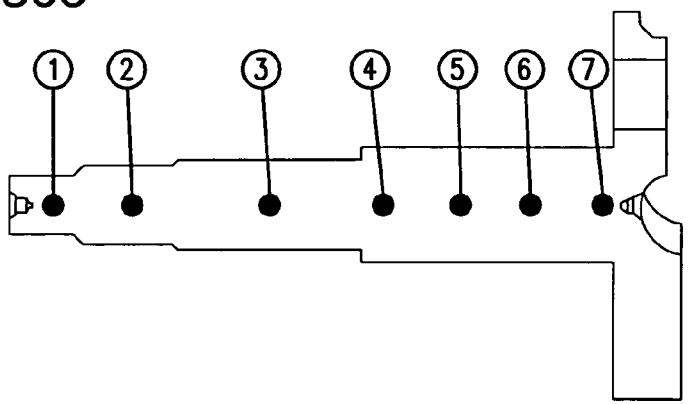
Figure 36B:
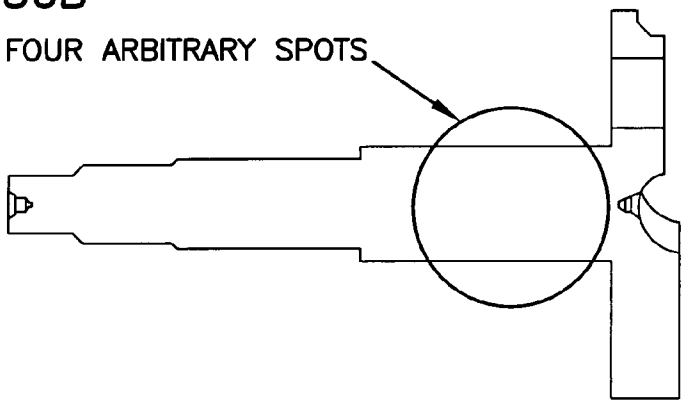

FIG. 36 shows details of a hardness measuring test for a crankshaft which was heated at 300° C. for 2 hours. FIG. 36(*a*) shows the timing of hardness measurement, FIG. 36(*b*) shows hardness measurement points before aging, and FIG. 36(*c*) shows hardness measurement points after aging.

Before aging, as shown in FIG. 36(*b*), arbitrary locations on the crankshaft were measured for surface hardness (HRC), and three crankshafts No. 1–No. 3 were tested. The results are shown in Table 6.

Table 6

As shown in FIG. 36(*c*), the hardness measurement points after aging were 7 locations (1)–(7) on the crankshaft for surface and internal hardness. The results are shown in Table 7:

Table 7

The average surface hardness (HRC) of the crankshaft No. 1 was 23.6 before aging and 23.9 after aging, with the average internal hardness (HRC) increased to 25.8. The average surface hardness (HRC) of the crankshaft No. 2 was 23.3 before aging and 24.2 after aging, with the average internal hardness (HRC) increased to 24.7. The average surface hardness (HRC) of the crankshaft No. 3 was 23.4 before aging and 24.4 after aging, with the average internal hardness (HRC) increased to 24.7. It is confirmed that the hardness (HRC) of either one of the crankshafts was increased by aging.

Figure 37A:
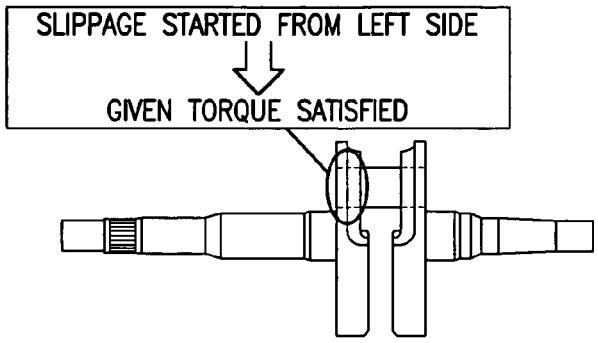
FIGS. 37(*a*), 37(*b*), and 37(*c*) are diagrams showing the results of a mechanical strength test conducted on a crankshaft according to a sixth invention.
Figure 37B:
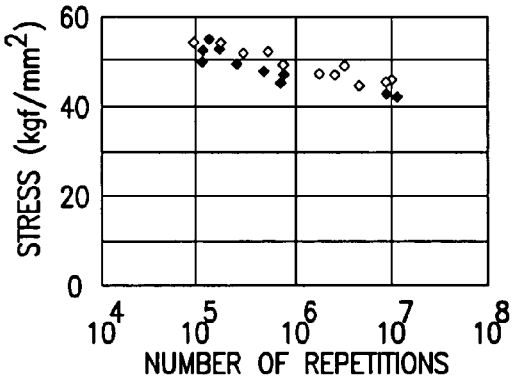
Figure 37C:
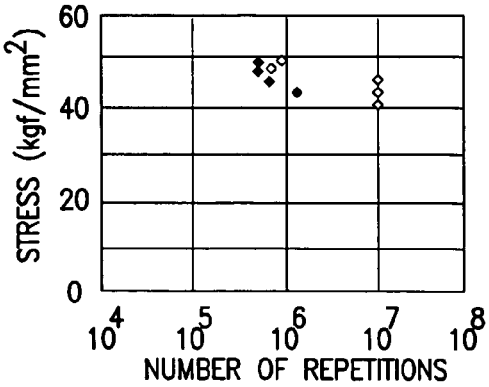

FIG. 37 shows the results of tests for measuring the slip torque and the solid fatigue strength of a crankshaft.

With respect to the crankshaft shown in FIG. 37(*a*), it was confirmed that the torque around the pin hole p in the left crankshaft at the time a slippage starts satisfies a predetermined torque value.

As shown in FIG. 37(*b*), the S-N diagram of a rotational bending fatigue test indicates that aged materials (blank marks) according to the present invention are essentially equivalent to conventional hot-forged blanks (solid marks). That is, the rotational bending strength of the aged materials according to the present invention are essentially equivalent to that of the conventional hot-forged blanks.

As shown in FIG. 37(*c*), the S—N diagram of an solid bending fatigue test indicates that aged materials (blank marks) according to the present invention are essentially equivalent to conventional hot-forged blanks (solid marks). That is, the solid bending strength of the aged materials according to the present invention are essentially equivalent to that of the conventional hot-forged blanks.

In the method of manufacturing a crankshaft according to the sixth invention, a crankshaft continuously formed of a carbon steel of constituents at predetermined proportions is aged by a low-temperature heat treatment for increasing hardness and mechanical strength. Therefore, machining processes for surface treatment and accuracy guarantee, which would otherwise be needed if hot-forged blanks were used, can be dispensed with, and crankshafts which are of good machining efficiency and high accuracy can be manufactured. The yield can also be increased, and large cost reduction can be achieved.

Figure 40:
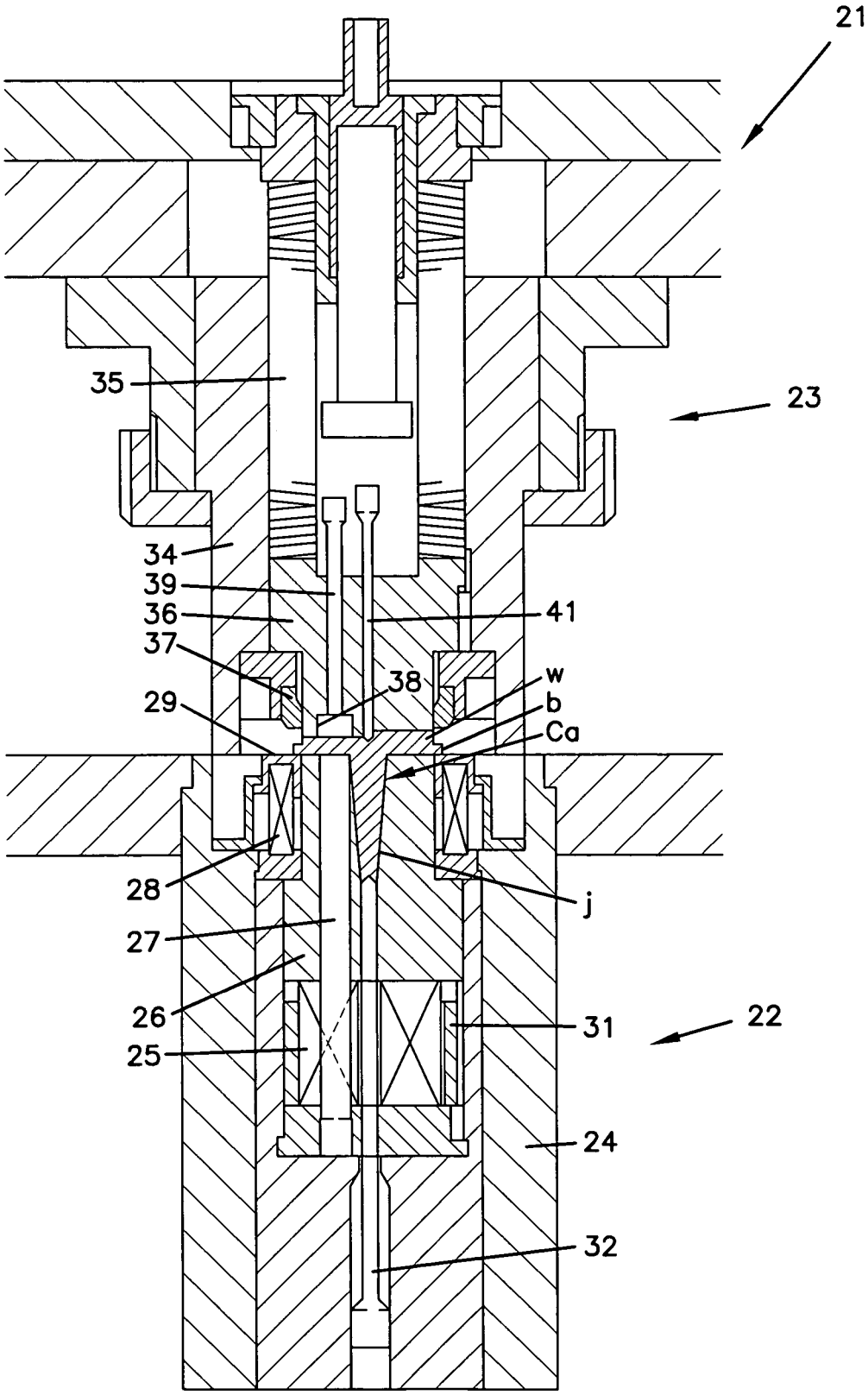
FIG. 40 is a cross-sectional view of a cold-forging die apparatus according to a seventh invention.
Figure 41A:
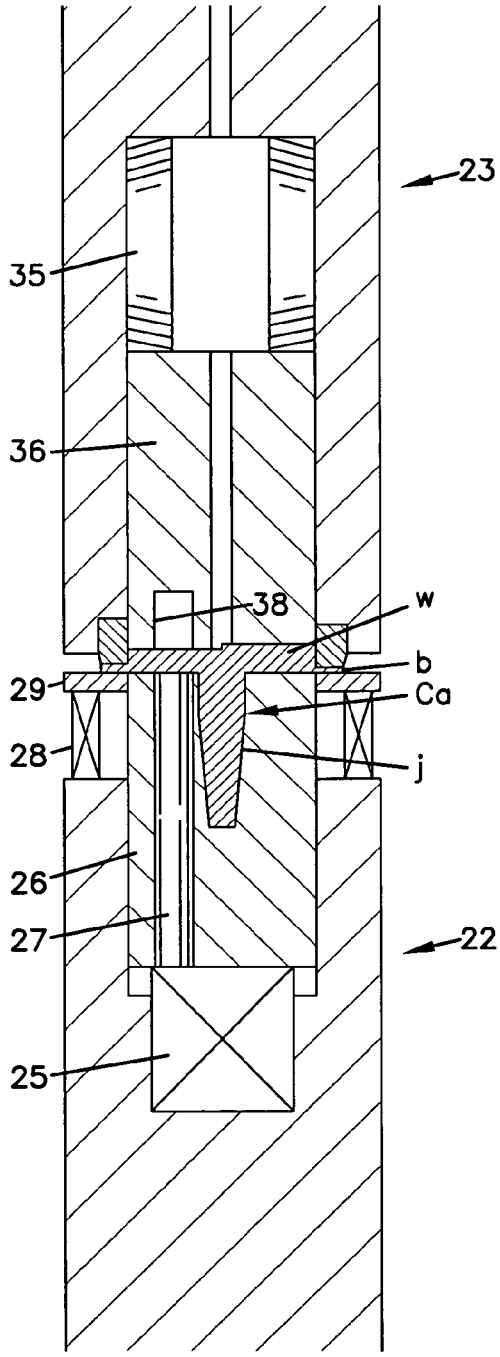
FIGS. 41(*a*), 41(*b*), 42(*a*), and 42(*b*) are cross-sectional views illustrative of a punching step carried out by the cold-forging die apparatus.
Figure 41B:
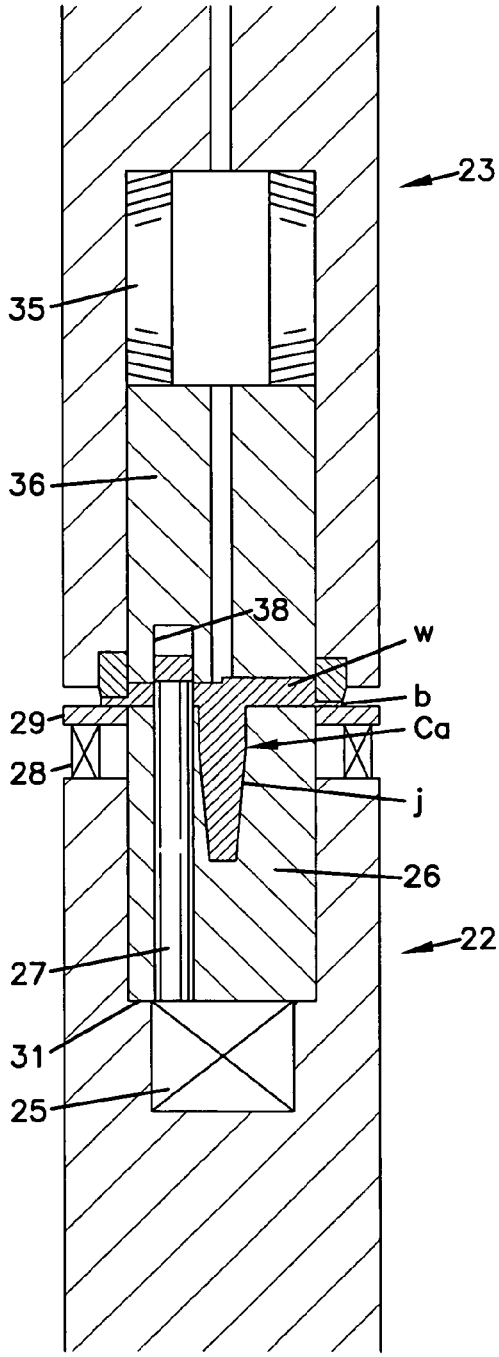
Figure 42A:
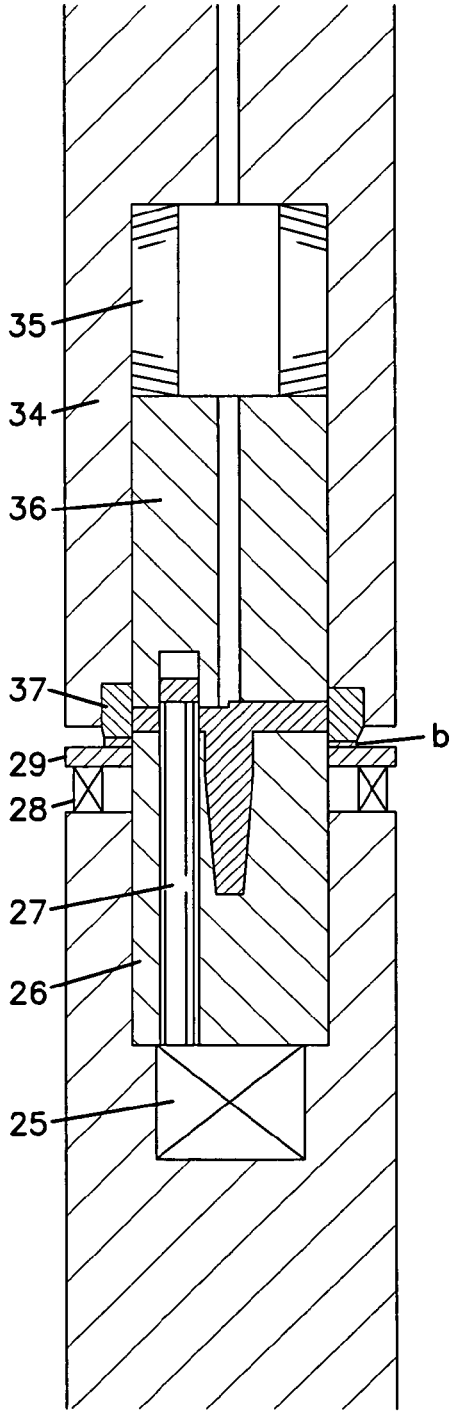
Figure 42B:
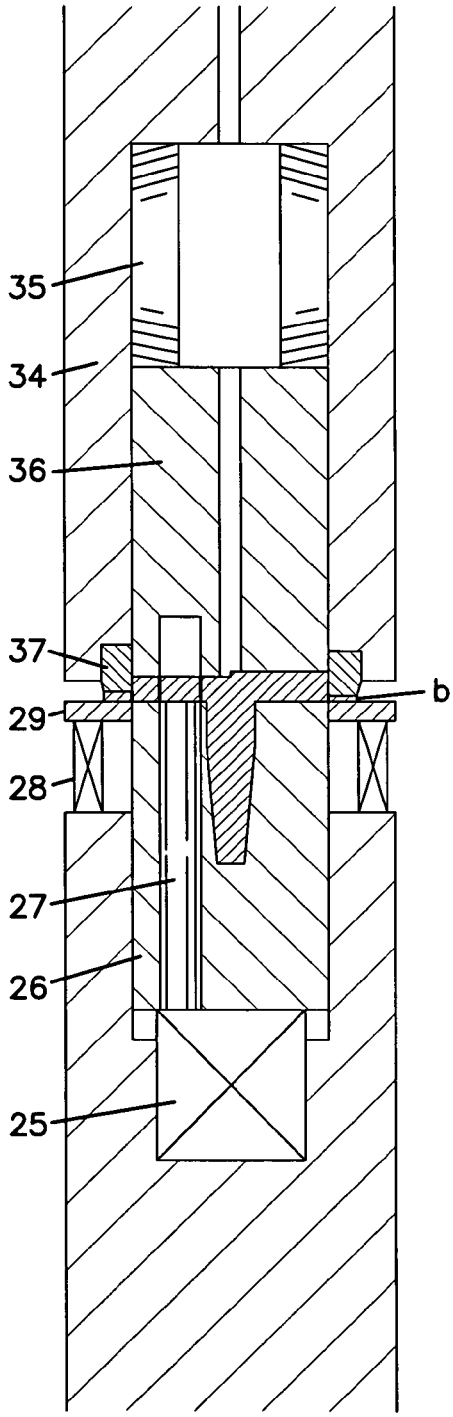

A seventh invention is concerned with a cold forging method and a forming die apparatus which simplify the manufacturing process by forming a pin hole in a disk and removing an outer peripheral portion from the disk of a disk-shaped component with a shaft, such as a cold-forged crankshaft. The seventh invention will be de scribed below with reference to FIGS. 40 through 42. FIG. 40 is a cross-sectional view of a forming die apparatus according to the seventh invention, and FIGS. 41 and 42 are cross-sectional views illustrative of a punching step carried out by the forging die apparatus.

The crankshaft has been described with reference to FIGS. 27 and 28, and will not be described below.

As shown in FIG. 40, a forming die apparatus 21 has an upper die assembly 23 vertically movable with respect to a lower die assembly 22. The lower die assembly 22 comprises a fixed base 24, a lower support base 26 vertically movably disposed in a central recess in the fixed base 24 and biased by a cushioning member 25 such as of urethane or the like, a punch 27 extending vertically through an intermediate portion of a certain region of the lower support base 26, and a stripper 29 disposed around an upper portion of the lower support base 26 and biased by a cushioning member 28 such as of urethane or the like. A position limiting member 31 is disposed below the lower support base 26 with a given clearance provided therebetween. The punch 27 has a lower end fixed to the fixed base 24 such that the upper end of the punch 27 lies substantially flush with the upper surface of the lower support base 26.

A lower knockout pin 32 is disposed centrally in the lower support base 26. The lower support base 26 has a holder hole defined in a portion thereof above the lower knockout pin 32 for fitting therein the multi-stepped shaft of a crankshaft.

When the multi-stepped shaft of a crankshaft is inserted and set in the holder hole, the lower surface of the counterweight of the crankshaft is supported by the upper surface of the lower support base 26, and a burr around the outer circumferential edge of the counterweight is supported by the upper surface of the stripper 29.

The upper die assembly 23 comprises a movable base 34, an upper support base 36 disposed centrally in the movable base 34 and biased by disc springs 35, and an upper die 37 disposed around the upper support base 36 and fixed to a lower portion of the movable base 34. The upper support base 36 has a receptacle 38 defined in a portion thereof which is aligned with the punch 27 of the lower die assembly 22, for receiving the punch 27 therein.

A scrap ejector pin 39 is disposed above the receptacle 38, and an upper knockout pin 41 is disposed centrally in the upper support base 36.

The cushioning member 25 which supports the lower surface of the lower support member 26 and the cushioning member 28 which supports the lower surface of the stripper 29 have a relatively weak spring rigidity, and the disc spring 35 above the upper support base 36 has a stronger spring rigidity.

The forming die apparatus 21 is applied to a crankshaft that has been formed by a continuous cold forging process, for simultaneously forming a pin hole in the counterweight of the crankshaft and removing a burr from the outer circumferential surface of the counter weight. A forming process carried out by the forming die apparatus 21 will be described below with reference to FIGS. 41 and 42.

As shown in FIG. 41(*a*), the multi-stepped shaft j of a crankshaft Ca is inserted and set in the holder hole defined centrally in the upper portion of the lower support base 26. At this time, the lower surface of the counterweight w of the crankshaft is supported by the lower surface of the lower support base 26, and a burr b on the outer circumferential surface of the counterweight w is supported by the stripper 29.

Then, the upper die 23 is lowered to bring the upper support base 36 into abutment against the upper surface of the counterweight w. The counterweight w is sandwiched and held between the upper support base 36 and the lower support base 26. Upon further descent of the upper die 23, since the spring rigidity of the cushioning members 25, 28 is weaker than the spring rigidity of the disc springs 35, the cushioning members 25, 28 are contracted, and the crankshaft Ca is lowered. As shown in FIG. 41(*b*), the punch 27 forms a pin hole P in the counterweight w. The lower support base 26 stops being lowered as its lower surface is engaged by the position limiting member 31.

As the upper die 23 further descends, as shown in FIG. 42(*a*), the disc springs 35 and the cushioning members 25, 28 are contracted, and the upper die 37 removes the burr b from the outer circumferential edge of the counterweight w. At this time, the scrap removed by the punch 27 enters the receptacle 38, and the burr b is placed between the upper die 37 and the stripper 29.

In this manner, the pin hole p is formed and the burr b is removed from the outer circumferential edge of the counterweight w at the same time.

Upon completion of the formation of the pin hole 0 and the removal of the burr b, the upper die 23 is lifted. As shown in FIG. 42(*b*), the scrap removed by the punch 27 returns to its original position in the pin bole p in the counterweight w, and the removed burr b returns to its original position around the counterweight w. These scraps will be discharged when the formed crankshaft or workpiece is ejected.

By having the multi-stepped shaft j fitted in the holder hole in the lower support base 26 and forming the pin hole p and removing the burr b in the manner described above, the accuracy of the pin hole p is ensured, and the outer circumferential edge of the counterweight is machined in good balance. As a result, any mechanical machining for accuracy guarantee can be dispensed with.

When the pin hole p is formed and the outer circumferential edge of the counterweight is machined at the same time according to the above process, the crankshaft is machined efficiently.

Since the scraps are returned to their original positions and then the workpiece is ejected, it is not necessary for the die assemblies to have scrap discharge passages, and the scraps can be discharged quickly.

According to the seventh invention, as described above, the disk-shaped part with the shaft which has been cold-forged is held by the lower support base and the upper support base, then the upper die is lowered to lower the disk-shaped part with the shaft by a given stroke, thereby forming a hole in the disk with the punch of the lower die assembly, and thereafter the upper die is further lowered to cause the upper die to remove the burr from the outer circumferential edge of the disk. Therefore, the hole is formed in the disk and the burr is removed from the outer circumferential edge of the disk at the same time for increased productivity.

The hole is formed in the disk with good accuracy and the burr is removed from the outer circumferential edge of the disk with good balance. Because the scraps are returned to their original positions and then removed when the workpiece is ejected, it is not necessary for the die assemblies to have scrap discharge passages, and the scraps can be discharged quickly.

Figure 43:
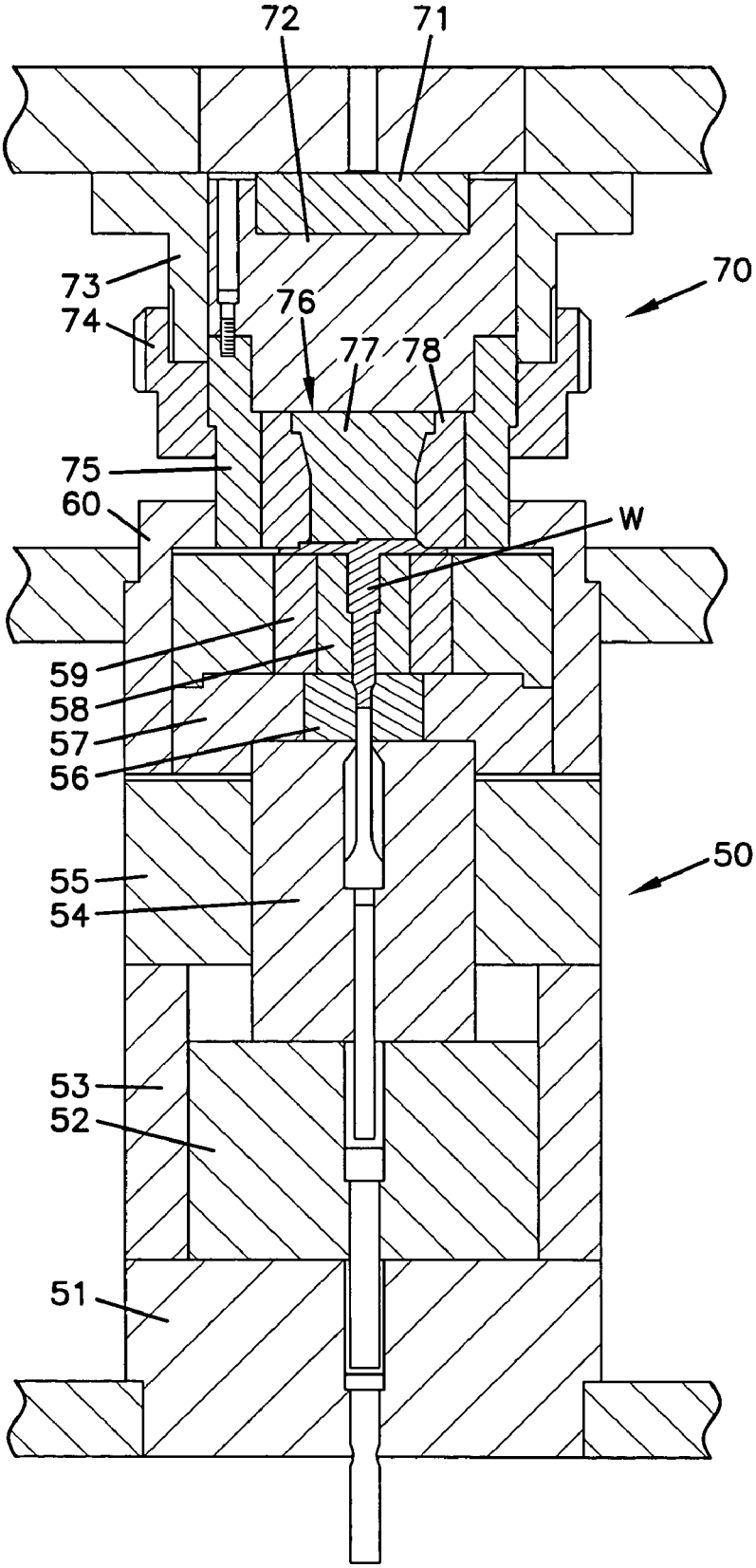
FIG. 43 is a cross-sectional view of a cold-forging die apparatus according to an eighth invention.
Figure 46:
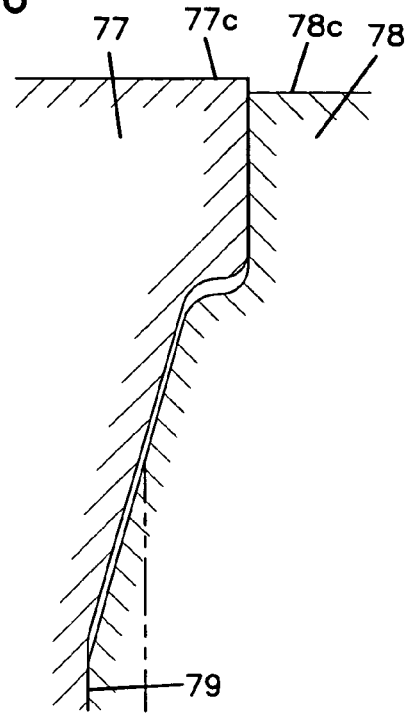
FIG. 46 is an enlarged view of an encircled portion B in FIG. 44.
Figure 47:
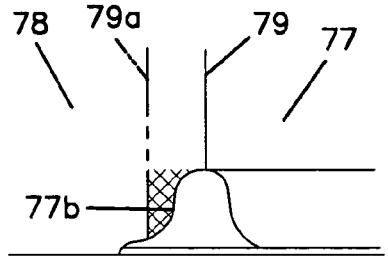
FIG. 47 is an enlarged view of an encircled portion C in FIG. 44.

An eighth invention is concerned with a cold forging die apparatus which is less subject to cracking. The eighth invention will be described below with reference to FIGS. 43 through 48. FIG. 43 is a cross-sectional view of a cold-forging die apparatus, FIG. 44 is a cross-sectional view of a punch of the cold-forging die apparatus, FIG. 45 is a view as viewed in the direction indicated by the arrow A in FIG. 44, FIG. 46 is an enlarged view of an encircled portion B in FIG. 44, and FIG. 47 is an enlarged view of an encircled portion C in FIG. 44.

The cold-forging die apparatus comprises a lower die assembly 50 and an upper die assembly 70. The lower die assembly 50 has a backup block 51 fixedly mounted on a base, a hard plate 52 disposed on the backup block 51, a hard plate guide ring 53 disposed around the hard plate 52, a die anvil 54 disposed on the hard plate 52, a die anvil guide ring 55 disposed around the die anvil 54, a drawing die insert 56 disposed on the die anvil 54, a drawing die reinforcing ring 57 disposed around the drawing die insert 56, an upsetting die insert 58 disposed on the drawing die insert 56, an upsetting die insert guide ring 59 disposed around the upsetting die insert 58, and a die guide ring 60 disposed around the drawing die reinforcing ring 57 and the upsetting die insert guide ring 59.

The upper die assembly 70 has an upper die backup block 72 attached to an upper die adjustment plate 71, a guide ring 73 disposed around the upper die backup block 72, an upper die fixing ring 74 threaded over a lower end of the guide ring 73, and a forming punch reinforcing ring 75 and a nib 76 which are held by the upper die fixing ring 74, the nib 76 being disposed in the forming punch reinforcing ring 75.

Figure 44:
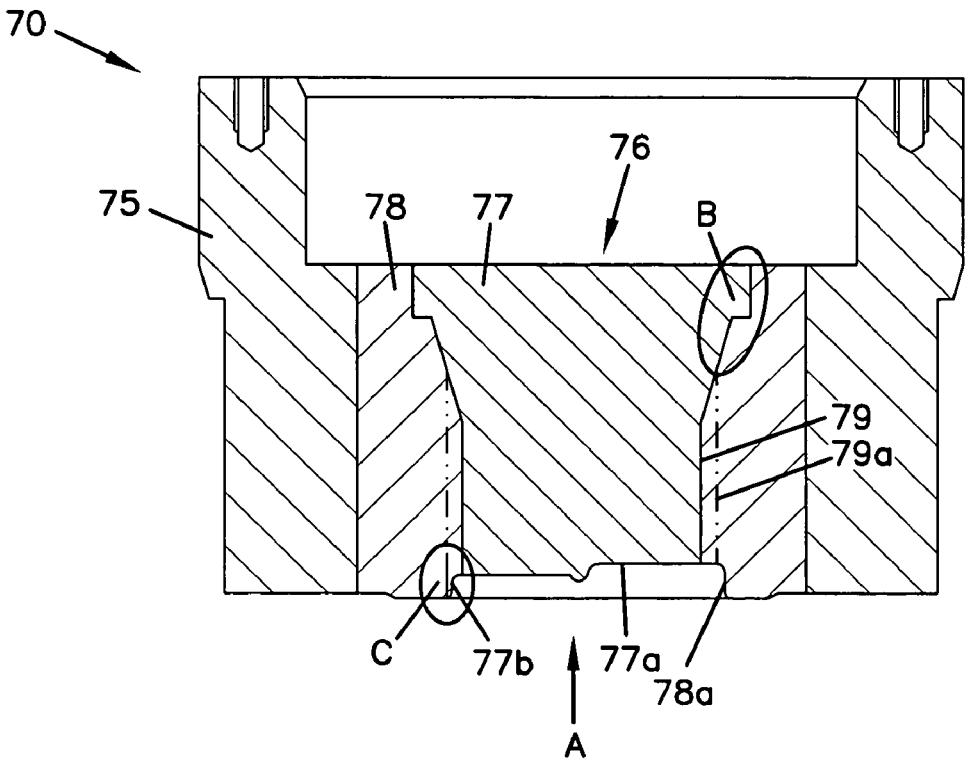
FIG. 44 is a cross-sectional view of a punch of the cold-forging die apparatus according to the eighth invention.
Figure 45:
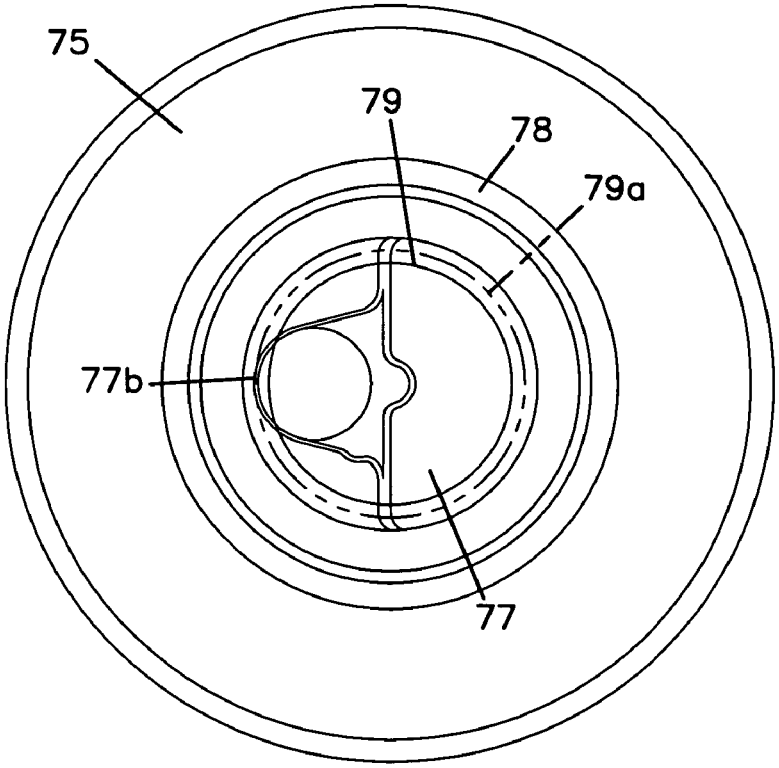
FIG. 45 is a view as viewed in the direction indicated by the arrow A in FIG. 44.

As shown in FIGS. 44 and 45, the nib 76 is split into an inner nib 77 and an outer nib 78. The inner nib 77 has a lower forming surface 77*a* for forming a counterweight and a pin hole portion, where a pin hole will subsequently be formed, of a crankshaft. The outer nib 78 has a lower forming surface 78*a* for forming an outer circumferential edge of the counterweight.

The forming surface 78*a* is subject to radially outward forces when it forms an outer circumferential edge of the counterweight. Therefore, tensile circumferential stresses are developed in the outer nib 78. The forming punch reinforcing ring 75 is used to reduce the stresses in the outer nib 78, i.e., to apply compressive circumferential stresses to the outer nib 78 in advance.

When the inner nib 77 is placed in the outer nib 78 by shrink fitting, since the outer nib 78 is forced radially outwardly, tensile circumferential stresses are developed in the outer nib 78.

As described above, the shrink fitting of the inner nib 77 in the outer nib 78 acts to cancel out the effect of the forming punch reinforcing ring 75. In order to make the forming punch reinforcing ring 75 effective, the shrink fitting allowance between the inner nib 77 and the outer nib 78 is set to 0.2%, and the shrink fitting allowance between the outer nib 78 and the forming punch reinforcing ring 75 is set to 0.5%.

A split surface 79 between the inner nib 77 and the outer nib 78 is located in the vicinity of a boundary between a region where radial stresses mainly act in the forming process and a region where axial stresses mainly act in the forming process.

While the upper die assembly 70 is being lifted, the shaft of a crankshaft blank W which has been formed preliminarily is inserted in the upsetting die insert 58. Then, the upper die assembly 70 is lowered to upset the counterweight of the crankshaft between the upsetting die insert 58 and the nib 76.

Figure 48:
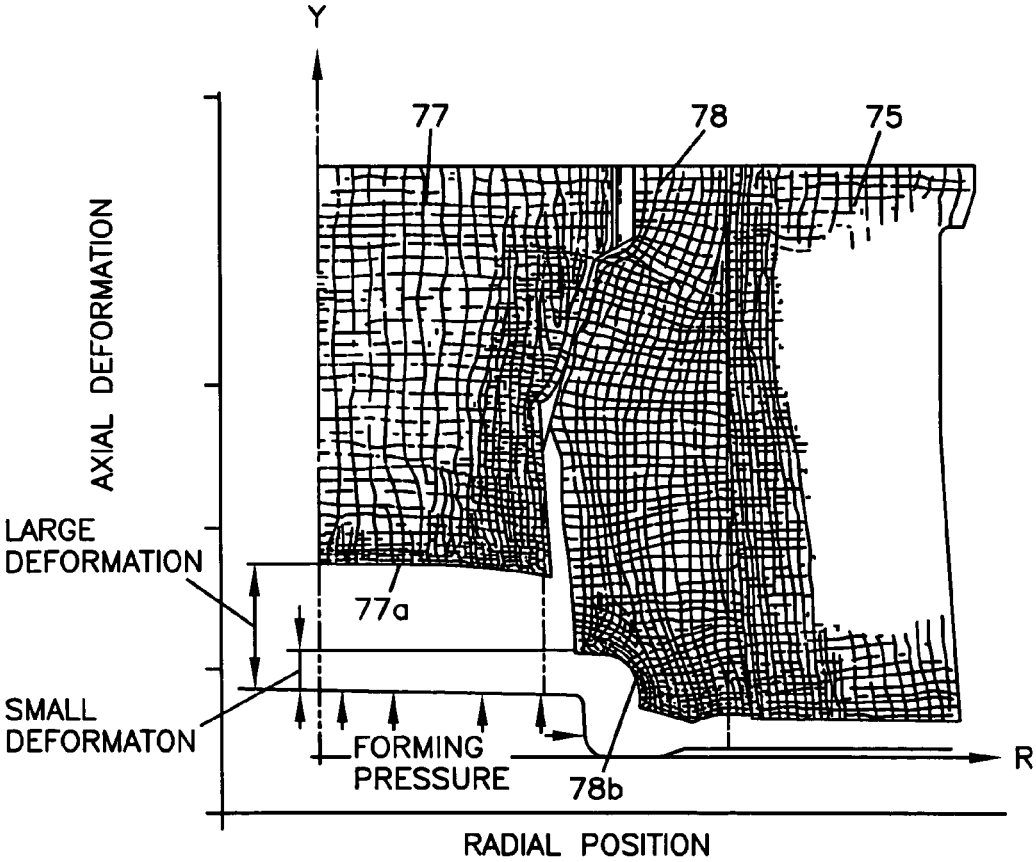
FIG. 48 is an enlarged schematic view showing the relationship between the radial position of a forming punch and the deformation of a die in a forming process.

The reason why the split surface 79 is located as described above will be described below with reference to FIG. 48. FIG. 48 is an enlarged schematic view showing the relationship between the radial position of the forming punch and the deformation of the die in the forming process. It can be seen from FIG. 48 that in the forming process, a force which is a combination of a radially outward force and an axially upwardly force, i.e., a force directed obliquely upwardly to the right, is applied to a corner 78*a* of the outer nib 78, and an axially upwardly force is applied to a lower surface 77*a* of the inner nib 77.

Therefore, it can be understood that if the nib 76 is not split, then it tends to crack in the boundary between these forces applied in different directions. With the split surface 79 located in the region which tends to crank, no undue force is applied to either one of the inner nib 77 and the outer nib 78.

From the standpoint of the boundary between the forces applied in different directions, the split surface 79 is more advantageous if located in a further outward position 79*a*. However, if the split surface is shifted outwardly of the position in the embodiment, then, as shown in FIG. 47, a thin portion 77*b* will be present in a portion of the inner nib 77, and tend to crack. For this reason, the split surface 79 is shifted slightly inwardly of the boundary between the forces applied in different directions in the embodiment. Insofar as no thin portion 77*b* is created, it is preferable that the boundary between the forces applied in different directions be used as the split surface 79.

As is apparent from FIG. 48, since a stronger axial force is applied to the inner nib 77 than to the outer nib 78, the axial deformation of the inner nib 77 is greater than the axial deformation of the outer nib 78, resulting in a step.

If the step remains as it is, then the step is transferred to the formed product, i.e., the crankshaft. In this embodiment, as shown in FIG. 46, with the formed lower end surfaces of the inner nib 77 and the outer nib 78 lying flush with each other, the inner nib 77 has an upper end surface 77*c* projecting slightly upwardly beyond an upper end surface 78*c* of the outer nib 78 by a distance of 0.2 mm in the embodiment.

With this arrangement, since the upper end surface 77*c* of the inner nib 77 and the upper end surface 78*c* of the outer nib 78 abut against the flat lower surface of the upper die backup block 72 and hence lie flush with each other, the forming surface 77*a* of the inner nib 77 projects slightly downwardly beyond the forming surface 78*a* of the outer nib 78. However, because a stronger axial force is applied to the inner nib 77 than to the outer nib 78, as described above, the axial deformation of the inner nib 77 is large, with the result that the forming surfaces 77*a*, 78*a* lie flush with each other and produce no step therebetween.

According to the eighth invention, the die apparatus for cold-forging a crankshaft or the like has the forming punch including the nib that is split into the inner nib and the outer nib, and the split surface between the inner nib and the outer nib is located in the vicinity of the boundary between the forces that are applied in different directions to the nib in the forming process. Therefore, the die assembly is less subject to cracking, and the service life of the cold-forging die assembly, which is placed under more burdens than hot forging die assemblies, can be extended.

The axial dimension of the inner nib is selected such that the inner nib projects axially beyond the outer nib in view of an axial displacement that occurs in the forming process. Therefore, no step is created across the split process in the forming process, and hence subsequent machining can be omitted.

Although certain preferred embodiments of the present invention have been shown and described in de tail, it should be understood that various changes and modifications may be made therein without departing from the scope of the appended claims.

TABLE 1

| | C | Si | Mn | P | S | Cu | Ni | Cr | Crack percentage (N = 100) |
|---|---|---|---|---|---|---|---|---|---|
| JIS S48C | 0.45~0.51 | 0.15~0.35 | 0.60~0.90 | 0.03 or less | 0.035 or less | 0.30 or less | 0.20 or less | 0.35 or less | 20% |
| Mn reduced | ↑ | ↑ | 0.55~0.65 | ↑ | ↑ | ↑ | ↑ | ↑ | 12% |
| Mn, C reduced | 0.45~0.48 | ↑ | 0.55~0.65 | ↑ | ↑ | ↑ | ↑ | ↑ | 5% |
| Mn, C reduced Inclusions reduced | 0.45~0.48 | 0.14 or less | 0.55~0.65 | 0.015 or less | 0.015 or less | 0.15 or less | ↑ | ↑ | 0% |

TABLE 2

| | | Crack confirmation test | |
|---|---|---|---|
| Material | Process | Upsetting test | Crankshaft formation |
| R material | Cutting→Acid pickling→Spherodizing annealing→Shot blasting + Bonderizing | 8/10 = 80% | 10/10 = 100% |
| Controlled rolling material | Cutting→Acid pickling→Spherodizing annealing→Shot blasting + Bonderizing | 5/25 = 20% | 2/30 = 7% |

TABLE 2-continued

| Material | Process | Crack confirmation test | |
|---|---|---|---|
| | | Upsetting test | Crankshaft formation |
| R material | Acid pickling→Spherodizing annealing→Acid pickling. Bonderizing→Drawing. Acid pickling→Spherodizing annealing→Shot blasting + Bonderizing | 0/30 = 0% | 0/30 = 0% |
| Controlled rolling material | Acid pickling→Spherodizing annealing→Acid pickling. Bonderizing→Drawing, Acid pickling→Spherodizing annealing→Shot blasting + Bonderizing | 0/30 = 0% | 0/30 = 0% |
| Surface-hardened steel (present invention) | Cutting→Acid pickling→Spherodizing annealing→Shot blasting + Bonderizing | 0/20 = 0% | 0/30 = 0% |

TABLE 3

| Component | C | Si | Mn | P | S | Cu | Ni | Cr |
|---|---|---|---|---|---|---|---|---|
| Proportion (wt %) | 0.46~0.48 | 0.14 or less | 0.55~0.65 | 0.015 or less | 0.015 or less | 0.15 or less | 0.2 or less | 0.35 or less |

TABLE 4

| No | Aging time (300° C.) |
|---|---|
| A | No aging |
| B | 0.5 H |
| C | 1.0 H |
| D | 1.5 H |
| E | 2.0 H |
| F | 2.5 H |
| G | 4.0 H(Over Aging) |

TABLE 5

| No | Hardness (HRC) | | | d value (A) |
|---|---|---|---|---|
| | Before aging | After aging | (Internal) | |
| A | 23.3 | | | 2.0291 |
| B | 22.8 | 23.1 | 23.7 | 2.0300 |
| C | 23.4 | 23.6 | 24.5 | 2.0308 |
| D | 23.2 | 23.8 | 24.8 | 2.0308 |
| E | 23.4 | 23.9 | 24.5 | 2.0317 |
| F | 22.9 | 23.8 | 24.7 | 2.0300 |
| G | 23.4 | 23.7 | 24.4 | 2.0308 |

TABLE 6

| Point | No1 | No2 | No3 |
|---|---|---|---|
| 1 | 23.9 | 23.5 | 23.4 |
| 2 | 23.4 | 23.4 | 23.8 |
| 3 | 23.7 | 23.0 | 23.2 |
| 4 | 23.5 | 23.4 | 23.4 |
| Average | 23.6 | 23.3 | 23.4 |

TABLE 7

| Point | No1 | | No2 | | No3 | |
|---|---|---|---|---|---|---|
| | Surface | Internal | Surface | Internal | Surface | Internal |
| ① | 24.1 | 25.4 | 26.4 | 22.5 | 26.6 | 22.4 |
| ② | — | 27.8 | — | 24.6 | — | 23.4 |

TABLE 7-continued

| Point | No1 | | No2 | | No3 | |
|---|---|---|---|---|---|---|
| | Surface | Internal | Surface | Internal | Surface | Internal |
| ③ | 25.4 | 26.0 | 25.5 | 25.4 | 25.7 | 25.9 |
| ④ | 23.5 | 24.6 | 23.6 | 25.2 | 22.9 | 24.6 |
| ⑤ | 23.8 | 25.4 | 22.8 | 25.2 | 23.6 | 25.6 |
| ⑥ | 23.1 | 25.4 | 23.8 | 25.0 | 24.2 | 25.7 |
| ⑦ | 23.2 | 25.7 | 23.3 | 25.2 | 23.4 | 25.6 |
| Average | 23.9 | 25.8 | 24.2 | 24.7 | 24.4 | 24.7 |

The invention claimed is:

1. A forming die apparatus for forming a hole in a predetermined region of a disk of a disk-shaped part with a shaft which has been cold-forged, and removing an outer circumferential portion of the disk, comprising:

a lower die assembly and an upper die assembly, the lower die assembly including: a lower support base that is biased in a direction toward the upper die assembly and is movable over a predetermined range in a direction toward and away from the upper die assembly, the lower support base includes a hole defined therein that is configured to hold the shaft of the disk-shaped part; and a punch for forming the hole in the disk, the punch being fixed to the lower die assembly whereby the lower support base is movable relative to the punch; and the upper die assembly is movable toward and away from the lower die assembly, the upper die assembly including: an upper support base that is movable relative to the upper die assembly in a direction toward and away from the lower die assembly, and an upper die that is fixed to the upper die assembly whereby the upper support base is movable relative to the upper die.

2. The die forming apparatus of claim 1, wherein the bole in the lower support base is located centrally in the lower support base.

3. The die forming apparatus of claim 1, wherein the hole is a multi-stepped hole.

4. The die forming apparatus of claim 1, comprising a cushioning member engaged with the lower support base that biases the lower support base toward the upper die assembly.

5. The die forming apparatus of claim 4, wherein the cushioning member comprises urethane.

6. The die forming apparatus of claim 1, comprising a limiting member fixed in the lower die assembly that limits movement of the lower support base away from the upper die assembly.

7. The die forming apparatus of claim 1, wherein the lower die assembly includes a stripper disposed around the lower support base, and the stripper is biased in a direction toward the upper die assembly.

8. The die forming apparatus of claim 7, comprising a cushioning member engaged with the stripper that biases the stripper toward the upper die assembly.

9. The die forming apparatus of claim 8, wherein the cushioning member comprises urethane.

10. The die forming apparatus of claim 1, wherein the upper support base is biased in a direction toward the lower die assembly, and wherein the biasing force acting on the upper support base is greater than the biasing force acting on the lower support base.

11. The die forming apparatus of claim 10, wherein the upper support base is biased by a plurality of disc springs.

12. The die forming apparatus of claim 1, wherein the lower die assembly includes a lower knockout pin and the upper die assembly includes an upper knockout pin, wherein the upper and lower knockout pins include longitudinal axes that are aligned with the hole.

13. The die forming apparatus of claim 7, wherein the stripper is positioned on the lower die assembly to support the outer circumferential portion of the disk, and the lower support base is positioned to support the disk.

14. The die forming apparatus of claim 13, wherein the upper support base is positioned to engage the disk, and the upper die is positioned to engage the outer circumferential portion of the disk.

15. The die forming apparatus of claim 1, wherein the upper support base includes a receptacle defined therein, and the receptacle is aligned with the punch.

* * * * *